US009630031B2

(12) United States Patent
Thatcher

(10) Patent No.: US 9,630,031 B2
(45) Date of Patent: Apr. 25, 2017

(54) LIGHTWEIGHT PROTECTIVE FABRICS AND CLOTHING FOR PROTECTION AGAINST HOT OR CORROSIVE MATERIALS

(71) Applicant: CHAPMAN THERMAL PRODUCTS, INC., Salt Lake City, UT (US)

(72) Inventor: Tyler M. Thatcher, Salt Lake City, UT (US)

(73) Assignee: CHAPMAN THERMAL PRODUCTS, INC., Salt Lake City, UT (US)

( * ) Notice: Subject to any disclaimer, the term of this patent is extended or adjusted under 35 U.S.C. 154(b) by 441 days.

(21) Appl. No.: 14/067,089

(22) Filed: Oct. 30, 2013

(65) Prior Publication Data

US 2014/0047625 A1 Feb. 20, 2014

Related U.S. Application Data

(63) Continuation-in-part of application No. 13/018,213, filed on Jan. 31, 2011, which is a continuation-in-part (Continued)

(51) Int. Cl.
*A62B 17/00* (2006.01)
*D06N 3/18* (2006.01)

(Continued)

(52) U.S. Cl.
CPC ..... *A62B 17/003* (2013.01); *D02G 3/443* (2013.01); *D03D 1/0041* (2013.01); *D03D 15/12* (2013.01);

(Continued)

(58) Field of Classification Search
CPC ... A62B 17/003; D02G 3/443; D06M 15/277; D06M 15/643; D06M 2101/28;

(Continued)

(56) References Cited

U.S. PATENT DOCUMENTS 2,673,823 A 3/1954 Biefeld
2,759,900 A 8/1956 Caldwell (Continued)

FOREIGN PATENT DOCUMENTS

DE 19756209 7/1999
EP 0967060 12/1999

(Continued)

OTHER PUBLICATIONS

Meirowitz, R. "Precision Placement of Thin Polymeric Silicone Films within Fabrics", Journal of Coated Fabrics, vol. 27 (Jan. 1998).

(Continued)

*Primary Examiner* — Arti Singh-Pandey
(74) *Attorney, Agent, or Firm* — Workman Nydegger

(57) ABSTRACT

Lightweight, flexible protective fabrics for protecting a person, animal or other object from hot burning materials, hot high heat capacity and/or hot corrosive materials, such as hot molten metal, hot oily liquids (e.g., heating oil), hot gels, hot solids, hot sparks, and hot acids. The lightweight protective fabrics can be used to protect a person, animal or other object from hot molten metals, such as liquid metal zinc heated to a temperature of about 950° F. (510° C.) or greater, hot molten aluminum heated to a temperature of about 1150° F. (620° C.) or greater, burning phosphorus at temperature of about 1550° F. (843° C.) or greater, hot solid iron having a temperature of about 500° F. (260° C.) or greater, hot heating oil having a temperature of about 500°

(Continued)

F. (260° C.) or greater, and hot hydrochloric acid having a temperature of about 300° F. (150° C.) or greater.

18 Claims, 5 Drawing Sheets

Related U.S. Application Data of application No. 12/627,911, filed on Nov. 30, 2009, and a continuation of application No. PCT/US2010/057854, filed on Nov. 23, 2010, application No. 14/067,089, filed on Oct. 30, 2013, which is a continuation-in-part of application No. 11/691,248, filed on Mar. 26, 2007, now abandoned.

(60) Provisional application No. 60/786,853, filed on Mar. 29, 2006.

(51) Int. Cl.

| | |
|---|---|
| ***D02G 3/44*** | (2006.01) |
| ***D03D 1/00*** | (2006.01) |
| ***D03D 15/12*** | (2006.01) |
| ***D06M 15/277*** | (2006.01) |
| ***D06M 15/643*** | (2006.01) |
| ***D06N 3/00*** | (2006.01) |
| ***D06N 3/04*** | (2006.01) |
| ***D06N 3/12*** | (2006.01) |
| *D06M 101/28* | (2006.01) |

(52) U.S. Cl.

CPC ..... *D06M 15/277* (2013.01); *D06M 15/643* (2013.01); *D06N 3/0002* (2013.01); *D06N 3/0015* (2013.01); *D06N 3/047* (2013.01); *D06N 3/128* (2013.01); *D06N 3/183* (2013.01); *D06M 2101/28* (2013.01); *D06M 2200/10* (2013.01); *D06M 2200/30* (2013.01); *D06N 2209/065* (2013.01); *D06N 2209/067* (2013.01); *D06N 2209/143* (2013.01); *D06N 2211/10* (2013.01); *D10B 2321/10* (2013.01); *D10B 2401/063* (2013.01); *D10B 2503/06* (2013.01)

(58) Field of Classification Search

CPC ..... D06M 2200/10; D06M 2200/30; D06N 2209/065; D06N 2209/067; D06N 2209/143; D06N 2211/10; D06N 3/0002; D06N 3/0015; D06N 3/047; D06N 3/128; D06N 3/183; D10B 2321/10; D10B 2401/063; D10B 2503/06

See application file for complete search history.

(56) References Cited

U.S. PATENT DOCUMENTS

| | | | |
|---|---|---|---|
| 3,265,529 | A | 8/1966 | Caldwell |
| 3,326,713 | A | 6/1967 | Smith |
| 4,181,769 | A | 1/1980 | Plamondon |
| 4,287,261 | A | 9/1981 | West |
| 4,293,611 | A | 10/1981 | Martin |
| 4,297,265 | A | 10/1981 | Olsen |
| 4,478,895 | A | 10/1984 | Makami |
| 4,540,617 | A | 9/1985 | Kawanishi |
| 4,548,859 | A | 10/1985 | Kline |
| 4,666,765 | A | 5/1987 | Caldwell |
| 4,678,681 | A | 7/1987 | Obayashi |
| 4,778,544 | A | 10/1988 | Jones |
| 4,865,906 | A | 9/1989 | Smith |
| 4,943,475 | A | 7/1990 | Baker |
| 4,994,317 | A | 2/1991 | Dugan |
| 5,004,643 | A | 4/1991 | Caldwell |
| 5,091,243 | A | 2/1992 | Tolbert |
| 5,209,965 | A | 5/1993 | Caldwell |
| 5,242,744 | A | 9/1993 | Schryer |
| 5,279,878 | A | 1/1994 | Fottinger |
| 5,292,575 | A | 3/1994 | Metivaud |
| 5,322,727 | A | 6/1994 | Yankus |
| 5,401,566 | A | 3/1995 | Magee |
| 5,418,051 | A | 5/1995 | Caldwell |
| 5,506,043 | A | 4/1996 | Lilani |
| 5,569,348 | A | 10/1996 | Hefele |
| 5,607,758 | A | 3/1997 | Schwartz |
| 5,856,245 | A | 1/1999 | Caldwell |
| 5,869,172 | A | 2/1999 | Caldwell |
| 5,935,637 | A | 8/1999 | Caldwell |
| 6,040,251 | A | 3/2000 | Caldwell |
| 6,071,602 | A | 6/2000 | Caldwell |
| 6,083,602 | A | 7/2000 | Caldwell |
| 6,129,978 | A | 10/2000 | Caldwell |
| 6,287,686 | B1 | 9/2001 | Huang et al. |
| 6,289,841 | B1 | 9/2001 | Caldwell |
| 6,312,523 | B1 | 11/2001 | Caldwell |
| 6,342,280 | B1 | 1/2002 | Patrick |
| 6,416,613 | B1 | 7/2002 | Patrick |
| 6,670,291 | B1 | 12/2003 | Tompkins |
| 7,087,300 | B2 | 8/2006 | Hanyon et al. |
| 2001/0006865 | A1 | 7/2001 | Holman |
| 2002/0182967 | A1 | 12/2002 | Erb et al. |
| 2004/0018787 | A1 | 1/2004 | Bullock |
| 2004/0091705 | A1 | 5/2004 | Hanyon et al. |
| 2005/0025950 | A1 | 2/2005 | Hanyon et al. |
| 2005/0255772 | A1 | 11/2005 | Fung |
| 2007/0094763 | A1* | 5/2007 | Silver ..... A41D 13/00 2/69 |
| 2007/0231573 | A1 | 10/2007 | Thatcher |
| 2008/0096001 | A1 | 4/2008 | Emden |
| 2010/0071119 | A1 | 3/2010 | Thatcher |
| 2011/0145984 | A1 | 6/2011 | Thatcher |

FOREIGN PATENT DOCUMENTS

| | | |
|---|---|---|
| EP | 0779385 | 7/2000 |
| GB | 2090882 | 7/1982 |
| GB | 2236772 | 4/1991 |
| JP | 56156805 | 12/1981 |
| JP | 60126386 | 7/1985 |
| JP | 04118233 | 4/1992 |
| JP | 04234639 | 8/1992 |
| WO | WO 8000419 | 3/1980 |
| WO | WO 9630432 | 10/1996 |
| WO | WO 9636757 | 11/1996 |
| WO | WO 9636758 | 11/1996 |
| WO | WO9939031 | 8/1999 |

OTHER PUBLICATIONS

ASTM Standard F955-03, "Evaluating Heat Transfer through Materials for protective Clothing upon contact with Molten Subtances"; Oct. 2003.

Dixit, B., "Performance of Protective Clothing: Development and Testing of Asbestos substitutes," "Performance of Protective Clothing", ASTM STP 900, R.L. Barker and G. C. Colette, Eds., American Society for Testing and Materials, Philadelphia, 1986, pp. 446-460.

U.S. Appl. No. 11/691,248, Mailed Dec. 11, 2009, Office Action.

U.S. Appl. No. 11/691,248, Mailed May 11, 2010, Office Action.

U.S. Appl. No. 11/691,248, Mailed Sep. 28, 2010, Office Action.

U.S. Appl. No. 11/691,248, Mailed Dec. 7, 2010, Office Action.

U.S. Appl. No. 11/691,248, Mailed Mar. 17, 2011, Office Action.

U.S. Appl. No. 11/691,248, Mailed Jul. 19, 2011, Office Action.

U.S. Appl. No. 12/627,911, Mailed Aug. 15, 2011, Office Action.

U.S. Appl. No. 12/627,911, Mailed Mar. 26, 2012, Office Action.

U.S. Appl. No. 12/627,911, Mailed Nov. 9, 2012, Final Office Action.

U.S. Appl. No. 13/018,213, Mailed Nov. 22, 2011, Office Action.

U.S. Appl. No. 13/018,213, Mailed Apr. 3, 2012, Office Action.

(56) References Cited

OTHER PUBLICATIONS

U.S. Appl. No. 13/018,213, Mailed Nov. 23, 2012, Final Office Action.
U.S. Appl. No. 13/018,213, Mailed Jul. 15, 2013, Advisory Action.

* cited by examiner

LIGHTWEIGHT PROTECTIVE FABRICS AND CLOTHING FOR PROTECTION AGAINST HOT OR CORROSIVE MATERIALS

CROSS-REFERENCE TO RELATED APPLICATION

This application is a continuation-in-part of co-pending U.S. patent application Ser. No. 13/018,213, filed Jan. 31, 2011, which is a continuation-in-part of co-pending U.S. patent application Ser. No. 12/627,911, filed Nov. 30, 2009, and a continuation of PCT Application No. PCT/US2010/57854, filed Nov. 23, 2010. This application is also a continuation-in-part of co-pending U.S. patent application Ser. No. 11/691,248, filed Mar. 26, 2007, which claims the benefit of U.S. Provisional Application No. 60/786,853, filed Mar. 29, 2006. The disclosures of the foregoing applications are incorporated herein in their entirety.

BACKGROUND OF THE INVENTION

1. The Field of the Invention

The present invention is in the field of clothing for use in protecting a human or animal from burning, hot and/or corrosive materials.

2. The Relevant Technology

Fire retardant clothing is widely used to protect persons who are exposed to fire, particularly suddenly occurring and fast burning conflagrations. These include persons in diverse fields, such as race car drivers, military personnel, fire fighters, and metal workers, each of which may be exposed to deadly fires, heat, and extremely dangerous incendiary conditions. For such persons, the primary line of defense against severe burns and even death is the protective clothing worn over some or all of the body.

Even though fire retardant clothing presently exists, such clothing is not always adequate to reliably offset the risk of severe burns, or even death. This is particularly true in the case where a person is not only exposed to flame or high heat but contacted with hot or dangerous substances, such as a hot molten metal, hot liquid, hot gel, hot solid, hot sparks, hot acid, or other corrosive material. For example, splashing of sparks and molten metal could occur in the case of welders and steel or other metal workers who routinely handle molten metal as it is poured and otherwise transported to manufacture finished steel and other metal products.

Flammable fabrics such as cotton, linen, wool, silk, polyester, rayon, polyamides, cellulose acetate, and regenerated cellulose have been treated with fire retardant finishes to enhance fire retardance. While this may temporarily increase the flame retardant properties of such fabrics, typical fire retardant finishes are not permanent. Exposure of the treated fabric to UV radiation (e.g., sun light) and routine laundering can greatly reduce the fire retardant properties of the fabric. The user may then have a false sense of security, thus unknowingly exposing himself to increased risk of burns. There may be no objective way to determine, short of being caught in a fiery conflagration or similarly dangerous environment, whether a treated garment still possesses sufficient fire retardance to offset the risks to which the wearer may be exposed.

Conventional fabrics have also been treated with waterproofing materials to make an all-weather product. For example, U.S. Pat. Nos. 5,004,643 and 5,418,051 to Caldwell describe a treatment process for applying a silicone polymer to a fabric to render it permanently water repellant. However, the fabrics disclosed in the Caldwell patents do not provide adequate protection to a wearer exposed to hot high heat capacity materials, such as hot molten metal, hot liquids, hot gels, hot solids, or hot sparks, or hot corrosive materials, such as hot acids.

U.S. Pat. Nos. 6,287,686 and 6,358,608 to Huang et al. disclose a range of yarns and fabrics that preferably include about 85.5-99.9% by weight oxidized polyacrylonitrile ("O-Pan") fibers and about 0.1-14.5% by weight of one or more strengthening fibers. U.S. Pat. No. 4,865,906 to Smith, Jr. includes about 25-85% O-Pan fibers combined with at least two types of strengthening fibers. Flame retardant and heat resistant fabrics made according to the Huang et al. patents are sold under the name CARBONX by Chapman Thermal Products, Inc., located in Salt lake City, Utah. Such fabrics typically have a weight ranging from about 4-12 oz/yd$^2$ (e.g., about 7.5-11.5 oz/yd$^2$). A cut resistant version of the fabrics in Huang et al. is disclosed in U.S. Pat. No. 7,087,300 to Hanyon et al., which discloses adding metal, ceramic or O-Pan filaments to the O-Pan/strengthening fiber fabrics in Huang et al. Such fabrics were heavier as a result of including metallic filaments and were about 8-20 oz/yd$^2$.

Although the fabrics in Huang et al. and Hanyon et al. do not burn or melt like conventional fabrics, they nevertheless contain mostly organic materials and are still capable of charring and shrinking when exposed to molten metal, burning flammable materials, or other hot materials for extended periods of time. This can weaken such fabrics to the point of forming a hole or tear that compromises their ability to provide continuous protection to a living being or object. For example, when exposed to hot molten iron, such fabrics may suffer irreparable damage, thus offering little protection to a person exposed to hot high heat capacity materials, such as hot molten metal, hot liquids, hot gels, hot solids, or hot sparks, or hot corrosive materials, such as hot acids.

Typically, fabrics that are not prone to charring and shrinkage are made from inorganic materials, such as asbestos or fiberglass. However, such fabrics are also very heavy, are uncomfortable to wear, and are not suitable for or used to make clothing, such as shirts, pants, jumpsuits, and the like. Instead, they are typically fashioned into heavy blankets or thick gloves that are many times heavier. Dixit, "Performance of Protective Clothing Development and Testing of Asbestos Substitutes," *Performance of Protective Clothing, ASTM STP* 900, R. L. Barker and G. C. Coletts, Eds., American Society for Testing and Materials, Philadelphia, 1986, pp. 446-460 ("Dixit") discloses the use of heavy weight fiberglass gloves as substitutes for asbestos. The fiberglass fabrics in Dixit had a weight of 32-35 oz/yd$^2$, which was only slightly less than the 40 oz/yd$^2$ of the asbestos comparison fabric. Dixit disparaged fabrics made from organic fibers such as aramid and carbon (heat stabilized polyacrylonitrile) because they lack the high temperature and thermal stability properties of asbestos and give off toxic gases when used in high temperature applications where asbestos is used. Dixit discloses coating fiberglass fabric with silicone but teaches that such coating should be applied to one side in order to retain the soft hand and feel of the fabric on the uncoated side. According to the Caldwell patents, applying a "coating" of silicone to a fabric creates an uncomfortable fabric that lacks flexibility and breathability. Dixit does not disclose lightweight, flexible fabrics that offer adequate protection from hot dangerous materials while still being comfortable to wear.

BRIEF SUMMARY OF THE INVENTION

The present invention encompasses lightweight, flexible protective fabrics and methods of protecting a person, animal or other object from the effects of hot burning materials, hot high heat capacity and/or hot corrosive materials, such as burning liquids or gels, hot molten metal, hot oily liquids (e.g., heating oil), hot gels, hot solids, hot sparks, and hot acids. It has unexpectedly been found that fabrics made from O-Pan or other high LOI materials and in which the yarn strands are encapsulated or coated with a silicone polymer or other liquid shedding material (e.g., according to U.S. Patent Publication No. 2007/0231573) not only shed flammable liquids but can also protect a wearer from the effects of hot high heat capacity materials, such as molten metal, hot oily liquids, hot gels, hot solids, and hot sparks and/or hot corrosive materials, such as hot acids.

According to one embodiment, the protective fabrics as disclosed herein can be lightweight and therefore suitable for use in making clothing that can be worn over a person's body to cover the shoulders, torso, arms and legs. This is in sharp contrast to heavy weight inorganic asbestos and fiberglass fabrics, which can range from 32-40 oz./yd$^2$ even before being coated with silicone, which are not suitable for use as clothing that can be worn by a person. By contrast, the protective fabrics prior to encapsulation typically have a weight that is in a range of about 2 oz/yd$^2$ to about 20 oz/yd$^2$, preferably in a range of about 3 oz/yd$^2$ to about 17 oz/yd$^2$, more preferably in a range of about 4 oz/yd$^2$ to about 14 oz/yd$^2$, and most preferably in a range of about 5 oz/yd$^2$ to about 12 oz/yd$^2$. Because silicone encapsulation or coating of a lightweight fabric uses significantly less silicone polymer than coating a heavy fiberglass fabric with silicone, which yields a stiff, plugged, laminate material, the encapsulated fabrics are still very lightweight, and typically have a weight that is within the foregoing ranges.

One of the features of the disclosed protective fabrics is that they better resist charring, shrinkage and other deleterious effects that can compromise the physical integrity of the fabric when exposed to hot burning, hot high heat capacity, or corrosive substances, as compared to un-encapsulated O-Pan fabrics. This is unexpected since silicone polymers typically only provide water-resistance according to the Caldwell patents, not protection to the fabric or user when exposed to hot burning, hot high heat capacity, or corrosive substances. It is evidence that the water-proofing material of Caldwell exhibits synergy when applied to fabrics containing O-Pan, which can otherwise char, shrink and more easily tear when exposed to hot dangerous materials. Using the disclosed protective fabrics, a user can be protected against receiving second and third degree burns when exposed to such materials.

Methods disclosed herein include protecting a person, animal or other object from hot molten metals, such as liquid metal zinc heated to a temperature of about 950° F. (510° C.) or greater, hot molten aluminum heated to a temperature of about 1150° F. (620° C.) or greater, burning phosphorus at temperature of about 1550° F. (843° C.) or greater, hot solid iron having a temperature of about 500° F. (260° C.) or greater, hot heating oil having a temperature of about 500° F. (260° C.) or greater, and hot hydrochloric acid having a temperature of about 300° F. (150° C.) or greater. The ability to protect a wearer from heat from hot high heat capacity materials and/or hot corrosive materials is quite different from simply shedding liquids, even flammable liquids, such as gasoline, and is an unexpected result.

These and other advantages and features of the present invention will become more fully apparent from the following description and appended claims, or may be learned by the practice of the invention as set forth hereinafter.

BRIEF DESCRIPTION OF THE DRAWINGS

In order that the manner in which the above recited and other benefits, advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

I. Introduction and Definitions

Figure 1:
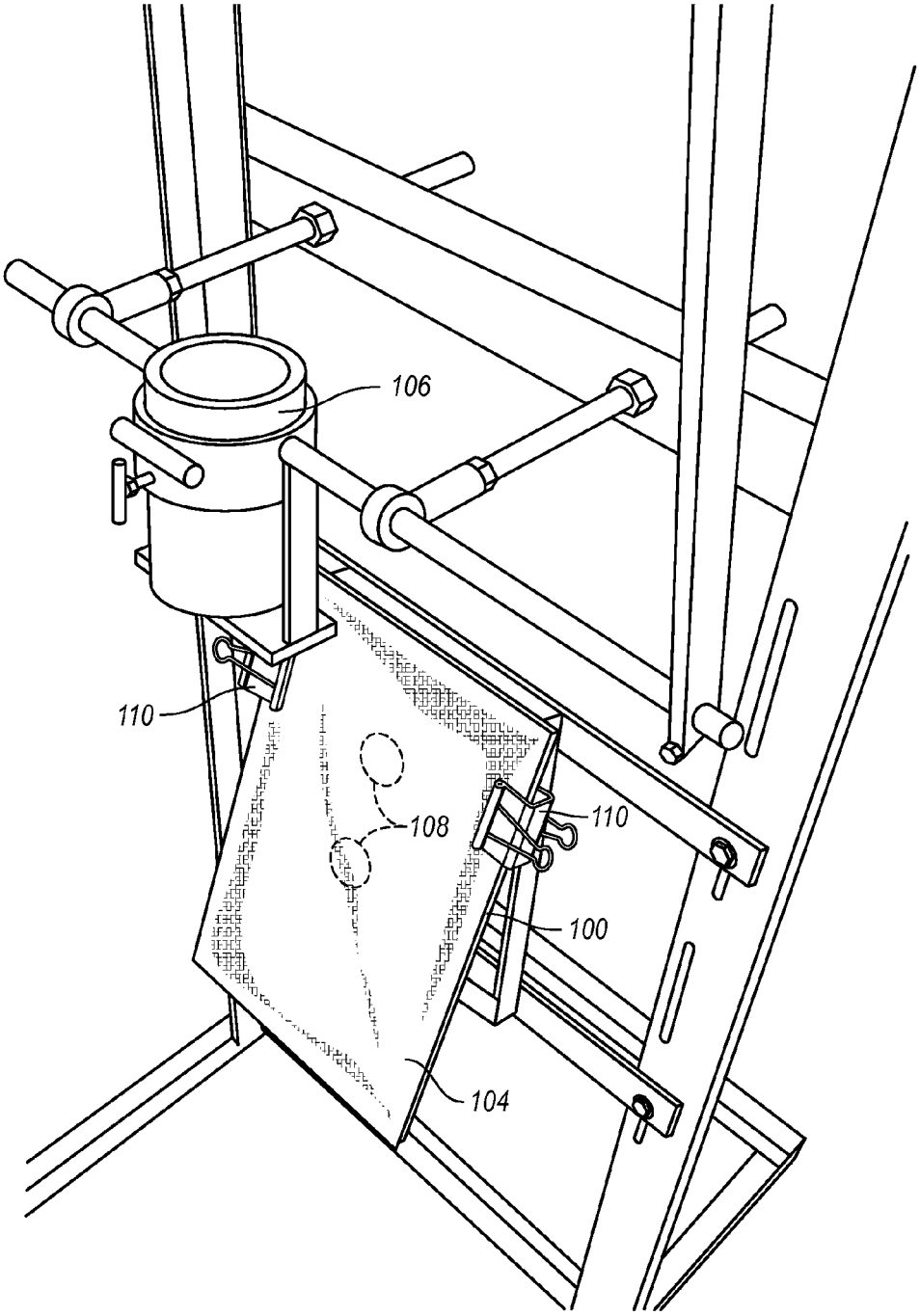
FIG. 1 is a perspective view of the testing apparatus used to evaluate heat transfer characteristics of a sample of fabric to be evaluated.

The present invention encompasses protective clothing, fabrics and methods for protecting a person, animal or other object from the effects of hot burning materials, hot high heat capacity and/or hot corrosive materials, such as hot molten metal, hot oily liquids (e.g., heating oil), hot gels, hot solids, hot sparks, and hot acids. It has unexpectedly been found that clothing and fabrics made from O-Pan or other high LOI materials and in which the yarn strands are encapsulated or coated with a water-shedding silicone polymer or other water-shedding material (e.g., according to U.S. Patent Publication No. 2007/0231573) not only shed flammable liquids but can also protect a wearer from the effects of hot burning materials, hot heat capacity materials, such as molten metal, hot liquids, hot gels, hot solids, and hot sparks and/or hot corrosive materials, such as hot acids. Silicone treatment helps to maintain structural integrity of the protective clothing and fabric by reducing charring and shrinking compared to an untreated O-Pan fabric. A user can be protected against receiving second and third degree burns when exposed to such materials.

The protective clothing, fabrics and methods are designed to protect a person, animal or object from hot burning materials, hot molten metals, such as liquid metal zinc heated to a temperature of about 950° F. (510° C.) or greater, hot molten aluminum heated to a temperature of about 1150° F. (620° C.) or greater, burning phosphorus at temperature of about 1550° F. (843° C.) or greater, hot solid iron having a temperature of about 500° F. (260° C.) or greater, hot heating oil having a temperature of about 500° F. (260° C.) or greater, and hot hydrochloric acid having a temperature of about 300° F. (150° C.) or greater. The ability to protect a wearer from heat from hot high heat capacity materials and/or hot corrosive materials is quite different from simply shedding liquids, even flammable liquids, such as gasoline, and is an unexpected result.

According to various example embodiments, protective clothing, fabrics and methods are provided for protecting an object exposed to a hot burning material, hot high heat capacity material and/or hot corrosive material having a temperature of at least about 300° F. (150° C.), or a temperature of at least about 400° F. (200° C.), or a temperature of at least about 500° F. (260° C.), or a temperature of at least about 600° F. (315° C.), or a temperature of at least about 750° F. (400° C.), or a temperature of at least about 950° F. (510° C.), or a temperature of at least about 1150° F. (620° C.).

The protective clothing and fabrics include yarn strands or cloth including yarn strands encapsulated or coated by a liquid/gel/spark/molten metal-resistant and strengthening coating to yield fabrics and articles that provide better tensile strength, abrasion resistance, durability, and the ability to protect a wearer from hot heat capacity materials, such as hot burning materials, hot molten metals, hot oily liquids, hot gels, hot solid metals, hot sparks, and hot corrosive materials, such as hot acids. Coating or encapsulating the yarn strands (e.g., so as to maintain breathability and/or flexibility), not only seals the individual yarn strands in superior fashion, it also maintains flexibility and/or breathability of the fabric. This is in sharp contrast to simply applying a coating of silicone to one or both sides of a fabric, which yields a stiff, heavy, laminated sheet having a board-like quality rather than a comfortable flexible and/or breathable fabric.

The term "Limiting Oxygen Index" (or "LOI") is defined as the minimum concentration of oxygen necessary to support combustion of a material. The LOI is primarily a measurement of flame retardancy rather than temperature resistance. Temperature resistance is typically measured as the "continuous operating temperature".

The term "tensile strength" refers to the maximum amount of stress that can be applied to a material before rupture or failure. The "tear strength" is the amount of force required to tear a fabric. In general, the tensile strength of a fabric relates to how easily the fabric will tear or rip. The tensile strength may also relate to the ability of the fabric to avoid becoming permanently stretched or deformed. The tensile and tear strengths of a fabric should be high enough so as to prevent ripping, tearing, or permanent deformation of the garment in a manner that would significantly compromise the intended level of thermal protection of the garment.

The term "abrasion resistance" refers to the tendency of a fabric to resist fraying and thinning during normal wear. Although related to tensile strength, abrasion resistance also relates to other measurements of yarn strength, such as shear strength and modulus of elasticity, as well as the tightness and type of the weave or knit.

The terms "fiber" and "fibers" refers to any slender, elongated structure that can be carded or otherwise formed into a thread. Fibers typically have a length of about 2 mm to about 75 mm and an aspect ratio of at least about 100:1. Examples include "staple fibers", a term that is well-known in the textile art. The term "fiber" differs from the term "filament", which is defined separately below and which comprises a different component of the inventive yarns.

The term "thread", as used in the specification and appended claims, shall refer to continuous or discontinuous elongated strands formed by carding or otherwise joining together one or more different kinds of fibers.

The term "filament" shall refer to a thread of indefinite length, whether comprising multiple fibers or a monofilament.

The term "yarn" shall refer to a continuous strand comprised of a multiplicity of fibers, filaments, or the like in bundled form, such as may be suitable for knitting, weaving or otherwise used to form a fabric.

The term "fabric" shall refer to an article of manufacture formed by knitting, weaving or otherwise joining a plurality of yarn strands together to form a multi-dimensional structure used to manufacture a wide variety of useful articles.

The term "clothing" shall refer to articles made from fabrics disclosed herein which are designed to be worn over a substantial portion of a person's body (e.g., at least 15, 25%, 50%, or 75%) and which are made using fabrics less than about 20 oz/yd$^2$. Example clothing will generally include sleeves and/or pant legs and wrap around the part of a user's body over which it is designed to be worn. Examples of articles of clothing include jump suits, lightweight gloves, socks, welding bibs, welding sleeves, welding mask shrouds (e.g., to protect the neck), breacher's coats, fire blankets, padding, protective head gear, linings, undergarments, bedding, drapes, and the like. The term "clothing" does not include gloves, bibs or other articles made from stiff, heavy fabrics having a weight greater than about 30 oz/yd$^2$. For example, the stiff, thick and heavy asbestos or fiberglass gloves disclosed in Dixit are excluded from the meaning of the term "clothing" for purposes of this disclosure and the appended claims.

The terms "encapsulate" and "outer shell" shall refer to the positioning or placement of a liquid-shedding, spark-shedding, and molten metal-shedding polymer material over or around an inner core comprising a yarn strand, before or after the yarn is formed into a fabric. The terms "outer layer", "encapsulate" and "outer shell" refer to the fact that at least some of the liquid/gel/spark/molten metal-shedding polymer material is located on an outer perimeter of the yarn strand(s). They do not mean that some of the liquid/gel/spark/molten metal-shedding polymer material that "encapsulates" the inner yarn core cannot also be located in interstitial spaces or pores within the inner yarn core. According to some embodiments, the polymer material may only be applied to one side of a fabric rather than both sides. In single sided embodiments, the treated side becomes the exterior of the article of manufacture, so that when the treated side is contacted by any liquids, gels, sparks, or molten metal, the fabric is able to shed these materials, protecting the wearer. The untreated side is inwardly oriented so as to contact the wearer's body or underclothes.

The terms "inner core" and "core fabric" shall refer to the fire retardant and heat resistant yarn or fabric that is encapsulated by the liquid/gel/spark/molten metal-resistant and strengthening polymer.

II. Protective Fabrics and Clothing

Fire retardant and heat resistant yarns used to make protective fabrics and clothing comprise at least one type of fire retardant and heat resistant fibers and/or filaments, preferably combined or blended with at least one type of strengthening fibers and/or filaments. Fire retardant and heat resistant fibers can be carded into a yarn, either alone or in combination with one or more types of strengthening fibers. Multiple yarns can be twisted or braided together to form a larger yarn strand. One or more fire retardant and heat resistant yarns comprising mainly or solely fire retardant and heat resistant fibers or filament(s) can be twisted or braided together with one or more strengthening strands comprising mainly or solely strengthening fibers and/or filament(s). Because a yarn strand typically consists of multiple strands twisted or braided together, it will typically include a substantial amount of interstitial space between the individual strands, at least before being encapsulated by the liquid/gel/spark/molten metal-shedding polymer.

Fabrics comprising the fire retardant and heat resistant yarns can be formed by knitting, weaving or otherwise combining multiple strands of yarn together. Any known method of forming a fabric from a yarn can be utilized to form the inventive fire retardant and heat resistant fabrics. Exemplary fire retardant and heat resistant yarns, fabrics and articles that can be improved according to the present invention are disclosed in U.S. Pat. Nos. 7,087,300, 6,287,686, 6,358,608, 6,800,367 and 4,865,906. For purposes of disclosing fire retardant and heat resistant yarns and fabrics capable of being encapsulated according to the invention, the disclosures of the foregoing patents are incorporated by reference.

According to several embodiments, fabrics disclosed herein are lightweight so as to be suitable for use as clothing that can be comfortably worn over a substantial portion of a user's body, particularly compared to stiff, heavy, board-like inorganic asbestos and fiberglass fabrics, which can range from 32-40 oz./yd$^2$ even before being coated with silicone, and which are typically only suitable for use as heavy gloves, bibs or blankets and have not been made into flexible, lightweight protective "clothing" as defined herein. By contrast, the protective fabrics prior to encapsulation typically have a weight that is in a range of about 2 oz/yd$^2$ to about 20 oz/yd$^2$, preferably in a range of about 3 oz/yd$^2$ to about 17 oz/yd$^2$, more preferably in a range of about 4 oz/yd$^2$ to about 15 oz/yd$^2$, and most preferably in a range of about 5 oz/yd$^2$ to about 12.5 oz/yd$^2$. By way of example, the O-Pan fabrics disclosed in U.S. Pat. Nos. 6,287,686, 6,358,608, 6,800,367 have weights within the foregoing ranges (e.g., about 5 oz/yd$^2$ to about 12 oz/yd$^2$). U.S. Pat. No. 7,087,300 discloses cut resistant fabrics incorporating metal filaments having a weight in a range of about 10-20 oz/yd$^2$. Because silicone encapsulation or coating of thin, lightweight fabrics uses significantly less silicone polymer than coating a heavy fiberglass fabric with silicone, which yields a stiff, plugged, laminate, board-like material, the encapsulated fabrics are still very lightweight, and typically have a weight that is within the foregoing ranges.

A. Fire Retardant and Heat Resistant Fibers and Filaments

Exemplary fire retardant and heat resistant fibers and filaments are made from oxidized polyacrylonitrile (O-Pan), which may be considered to be an "organic material" for purposes of this disclosure, as opposed to an "inorganic material" such as fiberglass or asbestos. The O-Pan fibers or filaments within the scope of the invention may comprise any type of O-Pan having high fire retardance and heat resistance. In a preferred embodiment, O-Pan is obtained by heating polyacrylonitrile (e.g., polyacrylonitrile fibers or filaments) in a cooking process between about 180° C. to about 3000° C. for at least about 120 minutes. This heating/oxidation process is where the polyacrylonitrile receives its initial carbonization. Preferred O-Pan fibers and filaments have an LOI of about 50-65. In most cases, O-Pan made in this way may be considered to be nonflammable.

Examples of suitable O-Pan fibers include LASTAN, manufactured by Ashia Chemical in Japan; PYROMEX, manufactured by Toho Rayon in Japan; PANOX, manufactured by SGL; and PYRON, manufactured by Zoltek. It is also within the scope of the invention to utilize filaments that comprise O-Pan. It was heretofore believed that fabrics that include a substantial amount of O-Pan fibers and/or filaments will resist burning and charring, even when exposed to intense heat or flame exceeding 3000° F. However, it has now been learned that O-Pan containing fabrics that include unencapsulated and unprotected yarns can, in fact, become charred, shrink, and become irreparably damaged when exposed to hot burning materials, hot molten metals and other high heat capacity materials.

Other fire retardant and heat resistant materials can be used in addition to, or in place of, O-Pan so long as they have fire retardant and heat resistance properties that are comparable to those of O-Pan. By way of example, polymers or other materials having an LOI of at least about 50 and which do not burn when exposed to heat or flame having a temperature of about 3000° F. could be used in addition to, or instead of, O-Pan.

The fire retardant and heat resistant yarn comprising the fabric portion of the protective article may consist solely of O-Pan fibers or filaments. When the O-Pan is blended with one or more strengthening fibers or filaments, O-Pan is preferably included in an amount in a range of about 25% to about 99.9% by weight of the fabric or yarn (exclusive of the polymer coating), more preferably in a range of about 40% to about 95% by weight, and most preferably in a range of about 50% to about 90% by weight of the fabric or yarn (exclusive of the polymer coating).

B. Strengthening Fibers and Filaments

Strengthening fibers and filaments that may be incorporated into fire retardant and heat resistant yarns, fabrics and clothing may comprise any fiber or filament known in the art. In general, preferred strengthening fibers will be those that have a relatively high LOI and TPP compared to natural organic fibers such as cotton, although the use of such fibers is within the scope of the invention. The strengthening fibers preferably have an LOI greater than about 20.

Strengthening fibers may be carded or otherwise formed into yarn, either alone or in combination with other fibers (e.g., O-Pan fibers). Strengthening yarns or filaments may be twisted, braided or otherwise combined with fire retardant and heat resistant strands to form a blended yarn.

Strengthening fibers and filaments include, but are not limited to, polybenzimidazole (PBI), polybenzoxazole (PBO), polyphenylene-2,6-benzobisoxazole (PBO), modacrylic, p-aramid, m-aramid, polyvinyl halides, wool, fire resistant polyesters, fire resistant nylons, fire resistant rayons, cotton, linen, and melamine. By way of comparison with O-Pan, which has an LOI of about 50-65, the LOI's of selected strengthening fibers are as follows:

| | |
|---|---|
| PBO | 68 |
| PBI | 35-36 |
| modacrylic | 28-32 |
| m-Aramid | 28-36 |
| p-Aramid | 27-36 |
| wool | 23 |
| polyester | 22-23 |

-continued

| | |
|---|---|
| nylon | 22-23 |
| rayon | 16-17 |
| cotton | 16-17 |

Examples of suitable p-aramids include KEVLAR, manufactured by DuPont; TWARON, manufactured by Twaron Products BB; and TECHNORA, manufactured by Teijin. Examples of suitable m-aramids include NOMEX, manufactured by DuPont; CONEX, manufactured by Teijin; and P84, an m-aramid yarn with a multi-lobal cross-section made by a patented spinning method, manufactured by Inspec Fiber. For this reason P84 has better fire retardant properties as compared to NOMEX.

An example of a PBO is ZYLON, manufactured by Toyobo. An example of a PBI fiber is CELAZOLE of PBI Performance Products, Inc. An example of a melamine fiber is BASOFIL. An example of a fire retardant or treated cotton is PROBAN, manufactured by Westex. Another is FIREWEAR.

Strengthening fibers and filaments may be incorporated in the yarns of the present invention in at least the following ways: (1) as one or more strengthening filaments twisted, wrapped, braided or otherwise joined together with threads or filaments comprising oxidized polyacrylonitrile; or (2) as fibers blended with O-Pan fibers into one or more yarns.

In short, strengthening fibers may be added to the inventive yarns in the form of strengthening yarns comprising one or more different types of strengthening fibers, a blended yarn comprising O-Pan fibers and one or more different types of strengthening fibers, or as a strengthening filament. When O-Pan is blended with one or more strengthening fibers or filaments, the strengthening fibers or filaments are preferably included in an amount in a range of about 0.1% to about 75% by weight of the fabric or yarn (exclusive of the polymer coating), more preferably in a range of about 5% to about 60% by weight, and most preferably in a range of about 10% to about 50% by weight of fabric or yarn (exclusive of the polymer coating).

C. Metallic and Ceramic Filaments

Yarns according to the invention may include one or more types of metallic or ceramic filaments in order to increase cut resistance, tensile strength and abrasion resistance. Metallic filaments typically have the highest combination of tensile strength and cut resistance but also conduct heat more rapidly. Examples of metals used to form high strength filaments include, but are not limited to, stainless steel, stainless steel alloys, other steel alloys, titanium, aluminum, copper, and the like.

Examples of high strength ceramic filaments include silicon carbide, graphite, silica, aluminum oxide, other metal oxides, and the like. Examples of high strength and heat resistant ceramic filaments are set forth in U.S. Pat. Nos. 5,569,629 and 5,585,312 to TenEyck et al., which disclose ceramic filaments that include 62-85% by weight $SiO_2$, 5-20% by weight $Al_2O_3$, 5-15% by weight MgO, 0.5-5% by weight $TiO_x$, and 0-5% $ZrO_2$. High strength and flexible ceramic filaments based on a blend of one or more oxides of Al, Zr, Ti, Si, Fe, Co, Ca, Nb, Pb, Mg, Sr, Cu, Bi and Mn are disclosed in U.S. Pat. No. 5,605,870 to Strom-Olsen et al. For purposes of disclosing high strength ceramic filaments, the foregoing patents are incorporated herein by reference. Fiberglass filaments can also be used.

Strengthening filaments preferably have a diameter in a range of about 0.0001" to about 0.01", more preferably in a range of about 0.0005" to about 0.008", and most preferably in a range of about 0.001" to about 0.006". Yarns containing a high concentration of oxidized polyacrylonitrile fibers that are generally too weak to be used in the manufacture of fire retardant and heat resistant fabrics can be greatly strengthened with even small percentages of one or more metallic filaments, and fabrics manufactured therefrom have been found to be surprisingly strong.

In general, where it is desired to maximize the strength of the material, it will be preferable to maximize the volume of strengthening filaments that are added to the yarn. However, it will be appreciated that as the amount of strengthening filaments increases in the yarn, the heat resistance generally declines. As a practical matter, the fire retardant and heat resistant requirements of the resulting yarn, fabric or other fibrous blend will determine the maximum amount of strengthening filaments that can be added to the yarn.

D. Treatment of Yarns and Fabrics

The fire retardant and heat resistant yarns and fabrics discussed above can be treated according to the invention by coating or encapsulating the yarn or fabric with a liquid shedding and strengthening polymer coating. Exemplary liquid-shedding and strengthening polymer materials, optional compositions applied to yarns in addition to the liquid shedding and strengthening polymer materials, as well as methods for coating or encapsulating yarns with the liquid shedding and strengthening polymer materials, are disclosed in U.S. Pat. Nos. 4,666,765, 5,004,643, 5,209,965, 5,418,051, 5,856,245, 5,869,172, 5,935,637, 6,040,251, 6,071,602, 6,083,602, 6,129,978, 6,289,841, 6,312,523, 6,342,280 and 6,416,613. It should be understood, however, that the materials disclosed in these patents were, prior to the invention, known to only provide a water-proofing treatment and, in addition, were shown by testing to not protect conventional fabrics from catastrophic damage when exposed to hot burning materials or hot molten metal. It is the unexpected and unpredictable synergy between such materials and the disclosed protective fabrics that results in protection to both the protective fabric itself and a wearer against the damaging effects of hot burning materials, hot high heat capacity materials and/or hot corrosive materials.

Exemplary liquid-shedding and strengthening polymer coatings include a wide variety of curable silicone-based polymers and polysiloxanes. Such polymers are typically applied as an uncured or partially cured polymer resin and then cured (i.e., cross-linked and/or further polymerized) after coating or encapsulating the yarn being treated. The polymer resins before application typically have a viscosity in a range of about 1000 cps to about 2,000,000 cps at a shear rate of 1/10 s and a temperature of 25° C. The polymer resins preferably have a viscosity in a range of about 5000 cps to about 10,000 cps at a shear rate of 1/10 s and a temperature of 25° C. In a most preferred embodiment, such polymer resins preferably contain less than about 1% by weight of volatile material. When cured, the coating or encapsulating polymers are preferably elastomeric in order to yield a generally flexible yarn, fabric or article.

A preferred class of liquid curable silicone polymer compositions comprises a curable mixture of the following components: (1) at least one organo-hydrosilane polymer or copolymer; (2) at least one vinyl substituted polysiloxane polymer or copolymer; (3) a platinum or platinum containing catalyst; and (4) optionally fillers and additives.

Typical silicone hydrides (component 1) are polymethylhydrosiloxanes which are dimethyl siloxane copolymers. Typical vinyl terminated siloxanes are vinyl-dimethyl terminated or vinyl substituted polydimethyl siloxanes. Typical catalyst systems include solutions or complexes of chloroplatinic acid in alcohols, ethers, divinylsiloxanes, and cyclic vinyl siloxanes.

Particulate fillers can be included to extend and reinforce the cured polymer composition and also improve the thixotropic behavior of the uncured polymer resins.

Exemplary silicone polymer resins that may be used to coat or encapsulate fire retardant and heat resistant yarns according to the invention include, but are not limited to, SILOPREN LSR 2530 and SILOPREN LSR 2540/01, which comprise a vinyl-terminated polydimethyl/siloxane with fumed silica and methylhydrogen siloxane, which are available from Mobay Chemical Co.; SILASTIC 595 LSR, a polysiloxane available from Dow Corning; SLE 5100, SLE 5110, SLE 5300, SLE 5500, and SLE 6108, which are polysiloxanes, and SLE 5106, a siloxane resin solution, all available from General Electric; KE 1917 and DI 1940-30, silicone polymers available from Shin-Etsu; LIQUID RUBBER BC-10, a silicone fluid with silicone dioxide filler and curing agents, available from SWS Silicones Corporation.

The foregoing silicone polymer resins are characterized as having high viscosity. Depending on the method of coating or encapsulation, in order for such polymer resins to properly coat or encapsulate the yarn, they may typically be thinned in some manner to reduce the viscosity so as to flow around the yarn and at least partially penetrate into the interstitial spaces within the yarn. This may be accomplished in any desired manner. According to one embodiment, the polymer resins are subjected to high shearing conditions, which causes them to undergo shear thinning and/or thixotropic thinning. Any suitable mixing blade, combination of blades, or other apparatus capable of applying high shear may be introduced into the vessel containing the polymer resin in order to temporarily reduce the viscosity of the resin before or during application to the yarn or fabric.

According to one method, such polymers may be encapsulated over the individual yarn strands of a tensioned fabric that is drawn through a bath of shear and/or thixotropically thinned polymer resin. Thereafter, the polymer resin is cured to form the final encapsulated yarn. Curing may be carried out using heat to accelerate polymerization and/or cross-linking or the polymer resin. The process advantageously only encapsulates the yarn strands but leaves spaces between the yarn strands that are woven or knitted together so as to permit the treated fabric to breathe. In this way, the treated fabric still feels and behaves more like an ordinary fabric rather than a laminate sheet or plugged fabric.

As an alternative to the above described encapsulation method in which the yarn or fabric is drawn through a bath of shear thinned polymer composition, the shedding polymer composition may be applied by a knife coating method. Generally speaking, in a knife coating method the uncured polymer composition is applied to the tensioned fabric, which then passes through a gap between a knife and a support roller. As the tensioned fabric substrate passes through the gap, the excess polymer composition is scraped off by the knife, further ensuring that the uncured polymer composition is evenly spread over individual yarns, resulting in proper coating. Because the fabric is under tension, the exposed surface of the individual yarn strands are coated, but in a manner that minimizes the total amount of silicone on the fabric, so as to permit the treated fabric to remain flexible and/or breath and therefore feel more like an ordinary fabric rather than a stiff, board-like fabric. Such a method may be used to coat only one side of a fabric. Of course, in embodiments where only one side of a fabric is treated, the treated side of the fabric becomes the protected exterior surface of the article of manufacture made from the fabric which exhibits the shedding ability, so that the exterior surface of the article is able to shed liquids, gels, sparks and molten metal. Preferably, both sides of the fabric are treated. In order to completely encapsulate the fabric substrate, the fabric may be processed again so as to coat the opposing surface of the fabric. It may also be possible to operate multiple knives simultaneously so as to coat both sides of a fabric in a single operation According to one embodiment, the silicone polymer resin is blended with a benzophenone (e.g., about 0.3-10 parts by weight of the silicone polymer), examples of which include 2,4-dihydroxybenzophenone (e.g., UVINUL 400, available from BASF), 2-hydroxy-4-methoxybenzophenone (e.g., UVINUL M-40, available from BASF), 2,2',4,4'-tetrahydroxybenzophenone (e.g., UVINUL D-50, available from BASF), 2,2'-dihydroxy-4,4'-dimethoxybenzophenone (e.g., UVINUL D-49, available from BASF), mixed tetra-substituted benzophenones (e.g., UVINUL 49 D, available from BASF), and 2-ethylhexyl-2-cyano-3,3-diphenylacrylate (e.g., UVINUL N-539, available from BASF).

The silicone polymer resin may also be blended with an accelerator (e.g., Dow Corning 7127 accelerator, a proprietary polysiloxane material) (e.g., 5-10 parts by weight of the silicone polymer resin) just before being applied to the yarn or fabric to promote curing.

The silicone polymer resin may further include various additives in order to impart desired properties to the yarn or fabric. Exemplary additives include UV absorbers, flame retardants, aluminum hydroxide, filling agents, blood repellants, flattening agents, optical reflective agents, hand altering agents, biocompatible proteins, hydrolyzed silk, and agents that affect thermal conductivity, radiation reflectivity, and/or electrical conductivity.

In general, the yarn is typically encapsulated with the liquid, spark, and molten metal-resistant coating after being woven or knitted into a fabric. Nevertheless, it is within the scope of the invention to coat or encapsulate the yarn before forming it into a fabric. One or more individual yarn strands can be encapsulated by drawing them through a bath of shear thinned polymer composition and then curing the polymer. The treated yarn strands may then be knitted, woven or otherwise joined together to form a desired fabric.

The silicone polymer coating is preferably applied to the yarn or fabric in an amount in a range of about 5% to about 200% by weight of the original yarn or fabric, more preferably in an amount in a range of about 10% to about 100% by weight of the original yarn or fabric.

Yarns and fabrics may also be advantageously pre-treated with a fluorochemical prior to being encapsulated by the silicone polymer resin in order to further increase the liquid, gel, spark, and molten metal shedding properties of the yarn or fabric. Exemplary fluorochemical compositions include, but are not limited to, MILEASE F-14N, F-34, F-31× and F-53 sold by ICI Americas, Inc.; PHOTOTEX FC104, FC461, FC731, FC208 AND FC232 sold by Ciba/Geigy; TEFLON polymers such as TEFLON G, NPA, SKF, UP, UPH, PPR, N and MLV, sold by DuPont; ZEPEL polymers such as ZEPEL B, D, K, RN, RC, OR, HT, 6700 AND 7040, also from DuPont; SCOTCHGUARD sold by 3M.

MILEASE F-14 contains approximately 18% perfluoroacrylate copolymer, 10% ethylene glycol, 7% acetone, and 65% water. MILEASE F-31X is a dispersion of fluorinated resin, acetone and water. ZEPEL 6700 is comprised of 15-20% perfluoroalkyl acrylic copolymer, 1-2% alkoxylated carboxylic acid, 3-5% ethylene glycol, and water, and has a pH of 2-5. ZEPEL 7040 is similar to ZEPEL 6700 but further contains 7-8% acetone. SCOTCHGUARD is comprised of aqueously dispersed fluorochemicals in polymeric form.

Liquid repellant fluorochemical compositions are saturated into the fabric or yarn to completely and uniformly wet the fabric or yarn. This may be performed by dipping the fabric or yarn in a bath of liquid composition or padding the composition onto and into the fabric or yarn. After applying the fluorochemical composition to the fabric or yarn, the water (or other liquid carrier) and other volatile components of the composition are removed by conventional techniques to provide a treated fabric or yarn that is impregnated with the dried fluorochemical. In one embodiment, the saturated fabric or yarn is compressed to remove excess composition. It is then heated to remove the carrier liquid by evaporation (e.g., at a temperature of about 130-160° C. for a period of time about 2-5 minutes). If the fluorochemical is curable, heating may also catalyze or trigger curing.

The fluorochemical may also contain a bonding agent in order to strengthen the bond between the fluorochemical and the yarn or fabric to which it is applied. Exemplary bonding agents include Mobay SILOPREN bonding agent type LSR Z 3042 and NORSIL 815 primer.

When included, the fluorchemical is preferably applied in an amount in a range of about 1% to about 10% by weight of the original yarn or fabric, more preferably in an amount in a range of about 2% to about 4% by weight of the original yarn or fabric.

III. Examples

Examples 1-62 illustrate various embodiments of lightweight protective fabrics and clothing that have unexpectedly been found to protect a wearer against the effects of hot heat capacity materials, such as hot molten metals, hot oily liquids, hot gels, hot solids, and hot sparks and also hot corrosive materials, such as hot acids. Examples 1-61 provide examples of useful lightweight proactive fabrics and Example 62 describes comparative testing of a 70:30 O-Pan and p-aramid encapsulated fabric as compared to an untreated 70:30 wt % blend of O-Pan and p-aramid.

Example 1

A lightweight protective fabric made from a yarn having a 70:30 wt % blend of O-Pan and p-aramid, respectively, is encapsulated with a liquid shedding and strengthening silicone-based polymer as follows. First, the fabric is placed under tension. Second, the tensioned fabric is drawn through a vessel containing a silicone-based polymer resin. Third, the silicone-based polymer resin is subjected to localized shear-thinning forces produced by a rapidly spinning shearing blade adjacent to a surface of the fabric in order for the shear-thinned resin to encapsulate the yarn of the fabric and at least partially penetrate into interstitial spaces of the yarn. The viscosity of the silicone-based polymer resin is sufficiently low that it does not plug the spaces between the individual yarn strands of the fabric. Fourth, the treated tensioned fabric is removed from the vessel containing the silicone-based polymer resin. Fifth, the treated fabric is heated in order to cure the silicone-based polymer resin and form the strengthening and liquid-shedding coating over the yarn.

The resulting lightweight protective fabric can be fashioned into lightweight, flexible and/or breathable protective article of clothing that not only provides has liquid-shedding properties, but unexpected provides a wearer against the effects of hot high heat capacity materials, such as hot molten metals, hot oily liquids, hot gels, hot solids, and hot sparks, and also hot corrosive materials, such as hot hydrochloric acid and other acids.

In addition, the protective fabric or clothing is lightweight (e.g., only about 7.5 oz/yd$^2$ to about 11.5 oz/yd$^2$), and optionally breathable, so as to provide far greater comfort as compared to heavy asbestos or fiberglass fabrics that are 32-40 oz/yd$^2$ used to make heavy blankets or gloves, whether or not coated with heavy silicone coatings, as in Dixit, which yield a very stiff, board-like fabric unusable for making clothing.

The fabric of Example 1 is also better able to resist charring, shrinkage compared to the untreated O-Pan fabric.

Example 2

A lightweight protective fabric made from a yarn having a 60:20:20 wt % blend of O-Pan, p-aramid, and m-aramid, respectively, is treated in the manner discussed in Example 1. The resulting lightweight fabric is somewhat stronger and more durable than the lightweight fabric obtained in Example 1 as a result of including a blend of strengthening fibers.

The lightweight protective fabric can be fashioned into lightweight protective clothing. The protective fabric or clothing is lightweight (e.g., less than about 15 oz/yd$^2$) and also can be breathable so as to provide far greater comfort as compared to asbestos or fiberglass fabrics that are 32-40 oz/yd$^2$ used to make heavy blankets or gloves, whether or not coated with heavy silicone coatings, which yield a stiff, board-like article that is entirely unsuitable for use in making articles of wearable clothing.

The lightweight protective fabric or clothing is also better able to resist charring and shrinkage compared to the untreated O-Pan fabric.

Example 3

A lightweight protective fabric made from a yarn consisting of 100% O-Pan is treated in the manner discussed in Example 1. Even though the lightweight fabric made from 100% O-Pan is relatively weak and fragile, treatment with the silicone polymer greatly increases the tensile strength, abrasion resistance, and durability so as to be acceptable for applications for which the fabric would otherwise be unacceptable absent the encapsulation treatment.

The lightweight protective fabric can be fashioned into lightweight, flexible protective clothing. The protective fabric or clothing is lightweight (e.g., less than about 15 oz/yd$^2$) and flexible so as to provide far greater comfort as compared to asbestos or fiberglass fabrics that are 32-40 oz/yd$^2$ used to make heavy blankets or gloves, whether or not coated with heavy silicone coatings.

The lightweight protective fabric or clothing is also better able to resist charring and shrinkage compared to the untreated O-Pan fabric.

Example 4

A lightweight protective fabric made from a yarn having a 40:20:20:20 wt % blend of O-Pan, p-aramid, fire retardant wool, and PBI, respectively, is treated in the manner discussed in Example 1.

The lightweight protective fabric can be fashioned into lightweight, flexible protective clothing. The lightweight protective fabric or clothing is lightweight (e.g., less than about 15 oz/yd$^2$) and advantageously breathable so as to provide far greater comfort as compared to asbestos or fiberglass fabrics that are 32-40 oz/yd$^2$ used to make heavy blankets or gloves, whether or not coated with heavy silicone coatings.

The lightweight protective fabric or clothing is also better able to resist charring and shrinkage compared to the untreated O-Pan fabric.

Example 5

A lightweight protective fabric made from a yarn having a 60:40 wt % blend of O-Pan and m-aramid, respectively, is treated in the manner discussed in Example 1. This lightweight fabric is significantly stronger to begin with compared to the fabrics of Example 1 as a result of include more strengthening fibers, but is less fire retardant and heat resistant.

The lightweight protective fabric can be fashioned into lightweight, flexible protective clothing. The protective fabric or clothing is lightweight (e.g., less than about 15 oz/yd$^2$) and flexible so as to provide far greater comfort as compared to asbestos or fiberglass fabrics that are 32-40 oz/yd$^2$ used to make stiff, heavy blankets or gloves, whether or not coated with heavy silicone coatings.

The lightweight protective fabric or clothing is also better able to resist charring and shrinkage compared to the untreated O-Pan fabric.

Example 6

A lightweight protective fabric made from a yarn having a 90:10 wt % blend of O-Pan and PBI, respectively, is treated in the manner discussed in Example 1. This fabric is not as strong as compared to the fabrics of Examples 1, 2, 4 and 5 as a result of including less strengthening fibers, but is more fire retardant and heat resistant as a result of including 10% PBI.

The lightweight protective fabric can be fashioned into lightweight, flexible protective clothing. The protective fabric or clothing is lightweight (e.g., less than about 15 oz/yd$^2$) and flexible so as to provide far greater comfort as compared to asbestos or fiberglass fabrics that are 32-40 oz/yd$^2$ used to make heavy blankets or gloves, whether or not coated with heavy silicone coatings, which yield board-like laminate materials.

The lightweight protective fabric or clothing is also better able to resist charring and shrinkage compared to the untreated O-Pan fabric.

Example 7

A lightweight protective fabric made from a yarn having a 60:10:15:15 wt % blend of O-Pan, p-aramid, polyvinyl chloride, and m-aramid, respectively, is treated in the manner discussed in Example 1. This fabric is quite strong as compared to previous examples as a result of including more and more types of strengthening fibers, but is less fire retardant and heat resistant.

The lightweight protective fabric can be fashioned into lightweight, flexible protective clothing. The protective fabric or clothing is lightweight (e.g., less than about 15 oz/yd$^2$) and flexible so as to provide far greater comfort as compared to asbestos or fiberglass fabrics that are 32-40 oz/yd$^2$ used to make heavy blankets or gloves, whether or not coated with heavy silicone coatings to make a board-like laminate, as in Dixit.

The lightweight protective fabric or clothing is also better able to resist charring and shrinkage compared to the untreated O-Pan fabric.

Examples 8-14

The lightweight protective fabrics of Examples 1-7 are pretreated with a fluorochemical prior to encapsulation with the silicone polymer. The fluorochemical is saturated into the fabric as a solution or suspension with a solvent. Excess fluorochemical composition is removed from the saturated fabric by applying pressure. Thereafter, the fluorochemical composition is heated in order to remove the solvent by evaporation and dry the fluorochemical. After applying the silicone polymer according to Example 1, the fluorochemical remains at least partially impregnated within the protective fabric.

The fluorochemical further enhances the liquid-shedding properties of the protective fabrics or clothing beyond what is provided by the silicone polymer encapsulation of Examples 1-7.

The lightweight protective fabric can be fashioned into lightweight, flexible protective clothing. The protective fabric or clothing is lightweight (e.g., less than about 15 oz/yd$^2$) and flexible so as to provide far greater comfort as compared to asbestos or fiberglass fabrics that are 32-40 oz/yd$^2$ used to make thick, heavy blankets or gloves, whether or not coated with heavy silicone coatings, which further renders them unsuitable for use in making wearable clothing.

The lightweight protective fabric or clothing is also better able to resist charring and shrinkage compared to the untreated O-Pan fabric.

Examples 15-33

Various lightweight protective fabrics and clothing are manufactured using any of the fabrics utilized in Examples 1-7. The silicone polymer coating used to treat the fire retardant and heat resistant fabric(s) according to Examples 15-33 are set forth in Table I below. The amount of silicone resin in the polymer coating is in all cases 100 parts. The "mixture ratio" refers to the ratio of packaged components as supplied by the manufacturer.

TABLE I

| Example | Silicone Resin | Mixture Ratio | Substituted Benzophenone | Parts | Other Additives | Part |
|---|---|---|---|---|---|---|
| 15 | Silopren ® LSR 2530 | 1:1 | Uvinul 400 | 5 | 7127 Accelerator[1] | 5/10 |
| 16 | Silastic ® 595 LSR | 1:1 | Uvinul 400 | 5 | Syl-off ® 7611[2] | 50 |
| 17 | SLE 5100, Liquid BC-10 | 10:1 1:1 | Uvinul 400 | 5 | Sylox ® 2[3] | 8 |

TABLE I-continued

| Example | Silicone Resin | Mixture Ratio | Substituted Benzophenone | Parts | Other Additives | Part |
|---|---|---|---|---|---|---|
| 18 | Silopren ® LSR 2530 | 1:1 | Uvinul 400 | 5 | Hydral ® 710[4] | 10 |
| 19 | Silopren ® LSR 1530 | 1:1 | Uvinul 400 | 5 | Silopren ® LSR Z3042[5] | 1 |
| 20 | SLE 5500 | 10:1 | Uvinul 400 | 5 | | |
| 21 | Silopren ® 2430 | 1:1 | Uvinul 400 | 5 | | |
| 22 | SLE 5300 | 10:1 | Uvinul 400 | 5 | | |
| 23 | SLE 5106 | 10:1 | Uvinul 400 | 5 | | |
| 24 | Silopren ® LSR 2530 | 1:1 | Uvinul 400 | 5 | Flattening Agent OK412 ®[6] | 4 |
| 25 | Silopren ® LSR 2530 | 1:1 | Uvinul 400 | 5 | Nalco ® 1SJ-612 Colloidal Silica[7] | 50 |
| 26 | Silopren ® LSR 2530 | 1:1 | Uvinul 400 | 5 | Nalco ® 1SJ-612 Colloidal Alumina[8] | 50 |
| 27 | Silastic ® 595 LSR | 1:1 | Uvinul 400 | 5 | 200 Fluid[9] | 7 |
| 28 | Silopren ® LSR 2530 | 1:1 | Uvinul 400 | 5 | | |
| 29 | Silastic ® 595 LSR | 1:1 | Uvinul 400 | 5 | Zepel ® 7040[10] | 3 |
| 30 | Silastic ® 595 LSR | 1:1 | Uvinul 400 | 5 | Zonyl ® UR[11] | 1/10 |
| 31 | Silastic ® 595 LSR | 1:1 | Uvinul 400 | 5 | Zonyl ® FSN-100[12] | 1/10 |
| 32 | Silopren ® LSR 2530 | 1:1 | Uvinul 400 | 5 | DLX-600 ®[13] | 5 |
| 33 | Silopren ® LSR 2530 | 1:1 | Uvinul 400 | 5 | TE-3608 ®[14] | 5 |

[1]7127 Accelerator (Dow Corning) is a polysiloxane
[2]Syl-off ® (Dow Corning) is a cross-linker
[3]Sylox ® 2 (W.R. Grace & Co.) is a synthetic amorphous silica
[4]Hydral ® 710 (Alcoa) is a hydrated aluminum oxide
[5]Silopren ® LSR Z3042 (Mobay) is a silicone primer (bonding agent) mixture
[6]Flattening Agent OK412 ® (Degussa Corp.) is a wax coated silicon dioxide
[7]Nalco ® 1SJ-612 Colloidal Silica (Nalco Chemical Co.) is an aqueous solution of silica and alumina
[8]Nalco ® 1SJ-612 Colloidal Alumina (Nalco Chemical Co.) is an aqueous colloidal alumina dispersion
[9]200 Fluid (Dow Corning) is a 100 cps viscosity dimethylpolysiloxane
[10]Zepel ® 7040 (DuPont) is a nonionic fluoropolymer
[11]Zonyl ® UR (DuPont) is an anionic fluorosurfactant
[12]Zonyl ® FSN-100 (DuPont) is a nonionic fluorosurfactant
[13]DLX-600 ® (DuPont) is a polytetrafluoroethylene micropowder
[14]TE-3608 ® (DuPont) is a polytetrafluoroethylene micropowder The silicone polymer resin and other components are mixed using a Hockmayer F dispersion blade at low torque and high shear. The protective lightweight fabric is tensioned and passed through a bath containing the silicone resin composition. Localized high shear is applied to the silicone resin composition near the surface of the fabric in order to coat the yarn strands comprising the fabric at a rate of 1.0 oz/sq. yd. The lightweight fabric is passed through the polymer resin composition several times to ensure thorough impregnation. After impregnation, the impregnated lightweight fabric is removed from the silicone polymer composition bath and passed through a line oven of approximately 10 yards in length, at 4-6 yards per minute, and cured at a temperature of 325-350° F.

The protective lightweight fabrics can be fashioned into lightweight, flexible protective clothing. The lightweight protective fabrics or clothing are lightweight (e.g., less than about 15 oz/yd$^2$) and flexible so as to provide far greater comfort as compared to asbestos or fiberglass fabrics that are 32-40 oz/yd$^2$ used to make heavy blankets or gloves, whether or not coated with heavy silicone coatings.

The lightweight protective fabric or clothing is also better able to resist charring and shrinkage compared to the untreated fabrics.

Examples 34-60

Various lightweight protective fabrics or clothing are manufactured according to any of Examples 8-14. The fluorochemical compositions used to pretreat the fire retardant and heat resistant fabric(s) according to Examples 34-60 prior to application of the silicone resin composition (which may comprise any of the compositions of Examples 15-33 in Table I) are set forth in Table II below.

TABLE II

| Example | Flurochemical |
|---|---|
| 34 | Milease ® F-14N |
| 35 | Milease ® F-34 |
| 36 | Milease ® F-31X |
| 37 | Milease ® F-53 |

TABLE II-continued

| Example | Flurochemical |
|---|---|
| 38 | Phobotex ® FC104 |
| 39 | Phobotex ® FC461 |
| 40 | Phobotex ® FC731 |
| 41 | Phobotex ® FC208 |
| 42 | Phobotex ® FC232 |
| 43 | Teflon ® G |
| 44 | Teflon ® NPA |
| 45 | Teflon ® SKF |
| 46 | Teflon ® UP |
| 47 | Teflon ® UPH |
| 48 | Teflon ® PPR |
| 49 | Teflon ® N |
| 50 | Teflon ® MLV |
| 51 | Zepel ® B |
| 52 | Zepel ® D |
| 53 | Zepel ® K |
| 54 | Zepel ® RN |
| 55 | Zepel ® RC |
| 56 | Zepel ® OR |
| 57 | Zepel ® HT |
| 58 | Zepel ® 6700 |
| 59 | Zepel ® 7040 |
| 60 | Scotchguard ® |

Prior to applying the fluorochemical composition, the lightweight protective fabric is washed with detergent, rinsed thoroughly, and hung to air dry. Thereafter, the fabric is soaked in water and then wrung dry to retain 0.8 g water/g fabric. The lightweight fabric is then treated with a solution or suspension (e.g., a 2% solution) of the fluorochemical composition, taking into account the water already soaked into the fabric (e.g., using a 2.5% solution of the fluorochemical). The pretreated lightweight fabric is wrung through a wringer and air dried. The lightweight fabric is then heated in an oven for 1 minute at 350° F. to remove any remaining solvent and sinter the fluorochemical. The fluorochemical treated fabric is then coated with a silicone polymer composition (e.g., a composition from one of Example 15-33).

The lightweight protective fabrics can be fashioned into lightweight, flexible protective clothing. The protective fabrics or clothing are lightweight (e.g., less than about 15 oz/yd$^2$) and flexible so as to provide far greater comfort as compared to asbestos or fiberglass fabrics that are 32-40 oz/yd$^2$ used to make heavy blankets or gloves, whether or not coated with heavy silicone coatings.

The lightweight protective fabric or clothing is also better able to resist charring and shrinkage compared to the untreated fabrics.

Example 61

Various lightweight protective fabrics are manufactured using the fabrics disclosed in Examples 1-7, the silicone resin compositions of Examples 15-33, and the fluorochemical compositions of Examples 34-60 (i.e., a wide range of different liquid, gel, spark, and molten metal-shedding and strengthened fire retardant and heat resistant fabrics are manufactured using every possible combination of fabrics, silicone resin compositions, and fluorochemical compositions of Examples 1-7, 15-33 and 34-60, respectively).

The lightweight protective fabrics can be used in the manufacture of a wide variety of clothing and other articles where protection against contact with hot high heat capacity materials and/or hot corrosive materials is desirable. Examples include, but are not limited to, clothing, jump suits, gloves, socks, welding bibs, welding sleeves, welding mask shrouds (e.g., to protect the neck), breacher's coats (e.g., as worn by military or other personnel while cutting through metal), fire blankets, padding, protective head gear, linings, undergarments, bedding, drapes, and the like. Clothing items are characterized as having a weight that is less than about 20 oz/yd$^2$, which is substantially less than asbestos and fiberglass fabrics having a weight of 32-40 oz/yd$^2$ and can have a stiff, board-like feel, particular when coated with thick, heavy silicone.

Comparative Example 1

Figure 2:
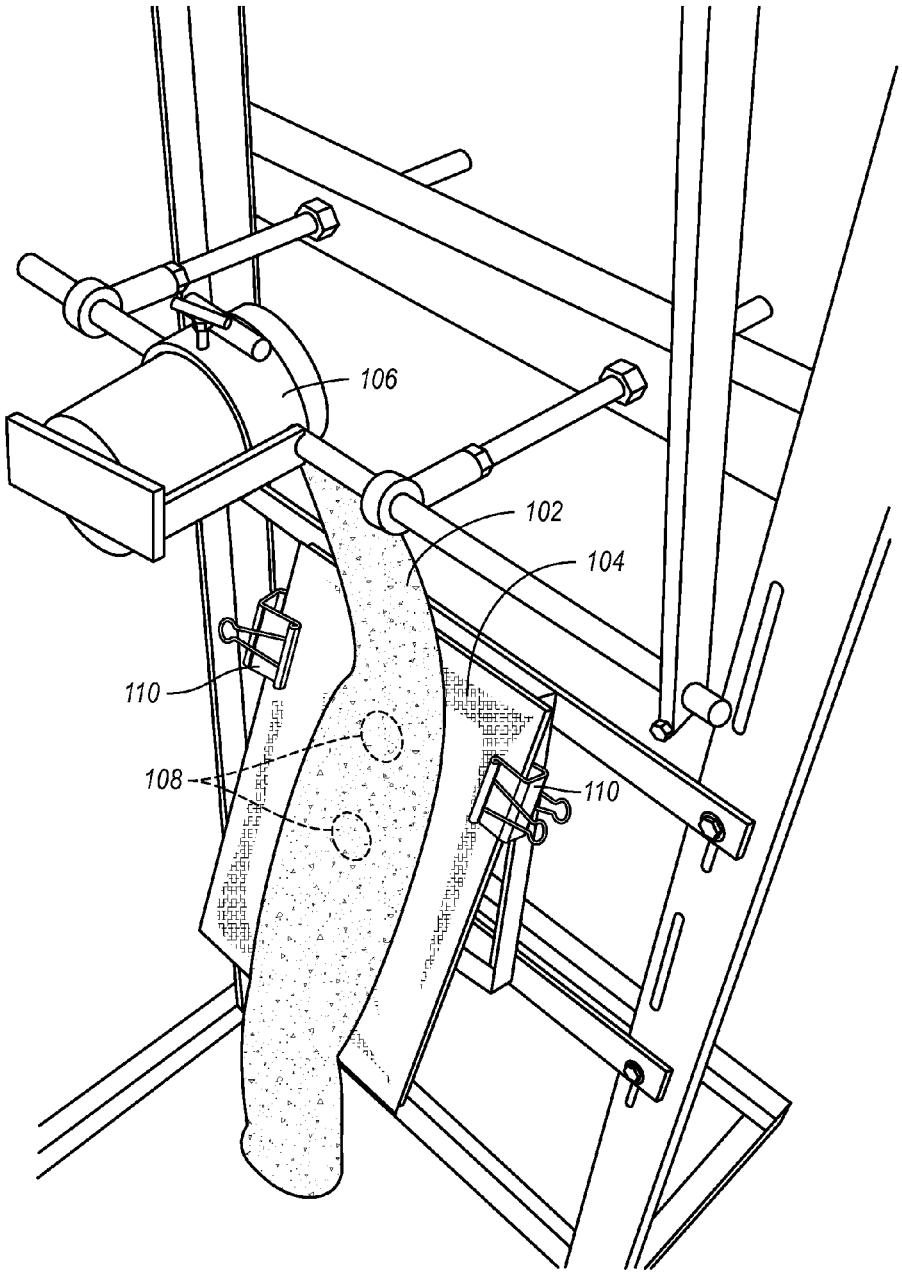
FIG. 2 is a perspective view of the testing apparatus of FIG. 1 with molten iron being poured onto the sample fabric.
Figure 3:
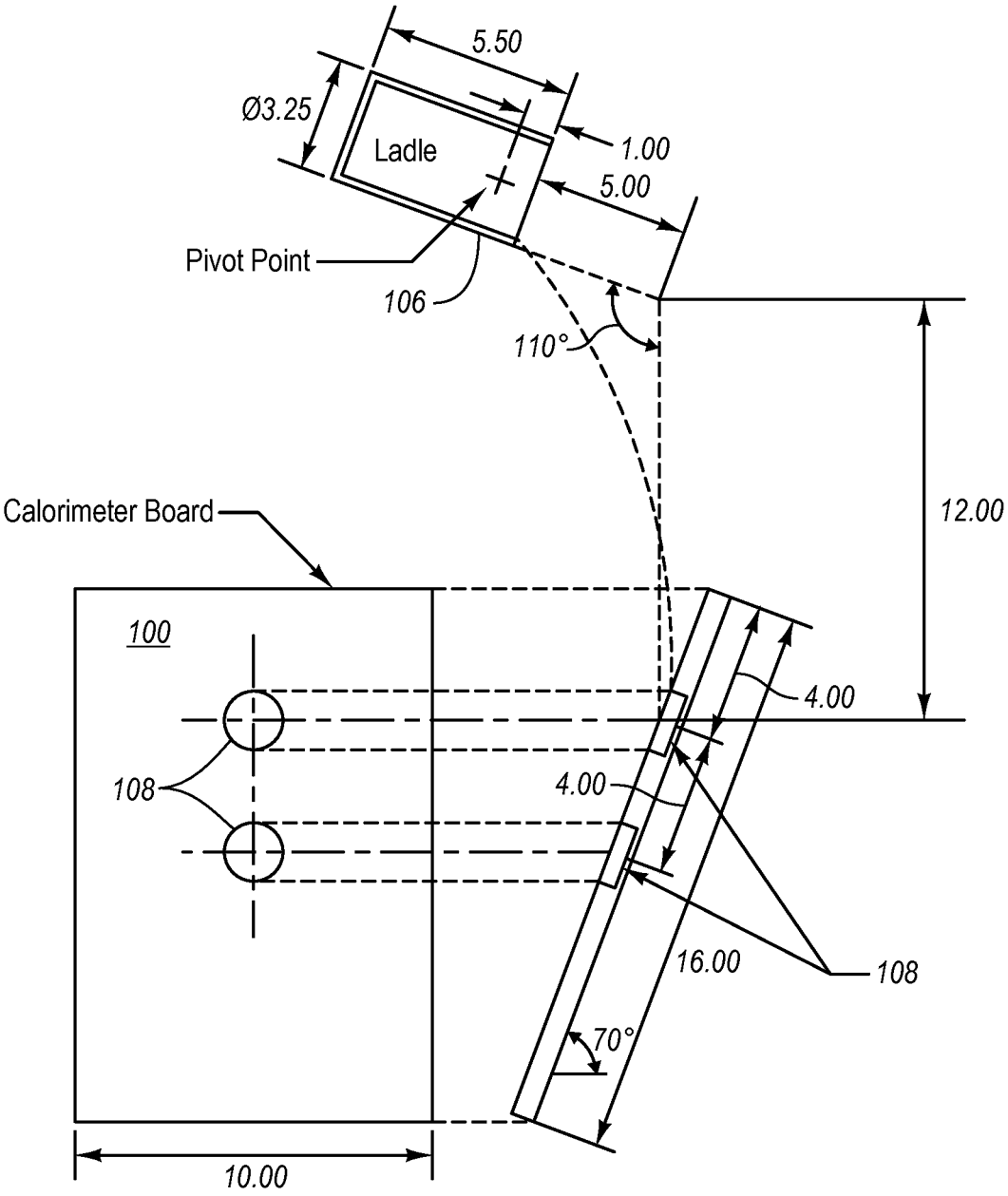
FIG. 3 is a schematic side view of the testing apparatus of FIG. 2.

A lightweight, flexible and fire retardant and heat resistant fabric (referred to hereafter as C59) suitable for manufacturing clothing, comprising a 86:14 wt % blend of O-Pan and p-aramid without a silicone-based polymer encapsulation treatment, and having a weight of about 6 oz/yd$^2$, was tested as compared to the same fabric (referred to hereafter as C59E) with a silicone-based polymer encapsulation treatment and having a weight of about 7.5 oz/yd$^2$ and also suitable for manufacturing clothing. The testing was in accordance with ASTM standard F955-03 entitled "Evaluating Heat Transfer through Materials for Protective Clothing upon Contact with Molten Substances." The standardized conditions for molten iron impact evaluations include pouring 1 kg±0.1 kg of molten iron at a minimum temperature of 2800° F. onto fabric samples attached to a calorimeter board. The testing set up is shown in FIGS. 1-3. The calorimeter board 100 was oriented at an angle of 70° from the horizontal and molten metal 102 dropped from a height of 12 inches onto a fabric sample 104 placed over calorimeter board 100. The ladle 106 containing the molten metal was rotated against a rigid stop and the molten metal 102 dumped onto the test fabric 104. The orientation of the ladle 106, calorimeter board 100, and calorimeters 108 before dumping is illustrated in FIG. 1.

Each fabric 104 to be tested was placed on the calorimeter board 100 and held in place with clips 110 along the upper edge of board 100. A preheated ladle 106 was filled with molten iron 102 from an induction furnace held at a temperature of approximately 2925° F. The molten metal weight was determined with an electronic balance and was maintained at 1 kg±0.1 kg. The filled ladle 106 was transferred to the ladle holder and splashed onto the fabric (FIG. 2). A fixed delay of 25 seconds after the start of the furnace pour was used to maintain a consistent metal impact temperature. Empirical testing has shown that metal temperature decreases by approximately 75-100° F. after the 25 second delay. The molten metal 102 was poured from the ladle 106 onto the fabric 104 and the results assessed. Each fabric 104 was tested using an undergarment consisting of a single layer of all-cotton T-shirt.

Visual examination was conducted on the impact fabric 104 for each sample tested. The visual appearance of each fabric 104 was subjectively rated in four categories after impact with molten metal 102. These categories were (1) charring, (2) shrinkage, (3) metal adherence, and (4) perforation. The rating system is outlined below, and the results are presented in Table III, below.

The char rating describes the extent of scorching, charring, or burning sustained by the fabric. The shrinkage rating provides an indication of the extent of the fabric wrinkling caused by shrinkage occurring around the area of metal impact. It is desirable to have a minimum amount of charring, wrinkling, and shrinkage during or after an impact event. Metal adherence refers to the amount of metal sticking to the fabric. The perforation rating describes the extent of fabric destruction in terms of the size, number of holes created, and penetration of molten metal through the fabric. It is desirable to have no perforation or penetration of molten metal through the fabric. The rating system uses numbers one through five in each category, with "1" representing the best behavior and "5" representing worst behavior.

Grading System Used to Evaluate Fabric Damage

The fabric samples were evaluated visually for charring, shrinkage, and perforation, to provide an indication of the extent of damage to the outer impacted layer. Five grades were used in evaluating the extent of charring:

1=slight scorching, fabric had small brown areas

2=slight charring, fabric was mostly brown in impacted area

3=moderate charring, fabric was mostly black in impacted area

4=charred, fabric was black and brittle, cracked when bent

5=severely charred, large holes or cracks, very brittle

Shrinkage was evaluated by laying the fabric on a flat surface and observing the extent of fabric wrinkling around the splash area. Shrinkage was evaluated using five categories:

1=no shrinkage

2=slight shrinkage

3=moderate shrinkage

4=significant shrinkage

5=extensive shrinkage

The adherence rating refers to the amount of metal sticking to the front of the fabric. Adherence of metal was rated using five categories:

1=none

2=small amount of metal adhered to face or back of fabric

3=a moderate amount of metal adhered to the fabric

4=substantial adherence of the metal to the fabric

5=large amount of adherence of metal to the fabric

Perforation was evaluated by observing the extent of destruction of the fabric, usually by holding it up to a light. Five grades were used in evaluating perforation:

1=none

2=slight, small holes impacted area

3=moderate, holes in fabric

4=metal penetration through the fabric, some metal retained on the fabric

5=heavy perforation, the fabric exhibited gaping holes or large cracks or substantial metal penetration to the back side The results are presented in Table III, below:

TABLE III

| Material Designation | Charring | Shrinkage | Adherence | Perforation |
|---|---|---|---|---|
| C59 Run 1 | 4 | 2 | 2 | 2 |
| C59 Run 2 | 4 | 2 | 2 | 2 |
| C59E Run 1 | 3 | 1 | 1 | 1 |
| C59E Run 2 | 3 | 1 | 1 | 1 |
| C59E Run 3 | 3 | 1 | 1 | 3 |

As shown in Table III, silicone escapsulation reduced charring from 4 to 3, a significant improvement, and essentially eliminated shrinkage, adherence and perforation. This is a surprising and unexpected result given the fact that testing of a conventional nylon fabric treated with the same silicone encapsulation treatment as C59E by applying molten metal (i.e., zinc) demonstrated that the silicone encapsulated nylon fabric still experienced substantial shrinkage, adherence and perforation.

The calorimeter board 100 to which the fabrics 104 were attached was constructed according to ASTM standard F955-03. The board 100 contained two 4 cm diameter, 1/16 inch thick copper disks 108. One copper disk was located at the point of molten metal impact, and the second was located 4 inches below the first. Each copper disk calorimeter 108 contained a single 30-gauge iron/constantan Type J thermocouple inserted into the back of the calorimeter 108. The thermocouple output from the calorimeter 108 was recorded with a high precision digital data acquisition system. The temperature rise for both calorimeters 108 was plotted for 45 seconds for each fabric sample tested. The total heat energy that flowed through the fabric was calculated at each time step using the following formula:

$$Q = \frac{m \times C_p \times (Temp_{final} - Temp_{initial})}{\text{Area}}$$

where:

Q=heat energy (J/cm$^2$), m=mass of copper slug (g), $C_p$=average heat capacity of copper during the temperature rise (J/g° C.), $Temp_{final}$=final temperature of calorimeter at $time_{final}$ (° C.), $Temp_{initial}$=initial temperature of calorimeter at $time_{initial}$ (° C.), Area=area of copper calorimeter.

This heat energy curve was compared to an empirical human predicted second-degree skin burn injury model (Stoll Curve). The Stoll Curve was calculated from the following formula:

$$\text{Stoll Curve (J/cm}^2\text{)} = 5.0204(t_j^{0.2901})$$

where $t_j$ is the time after molten metal impact.

Figure 4A:
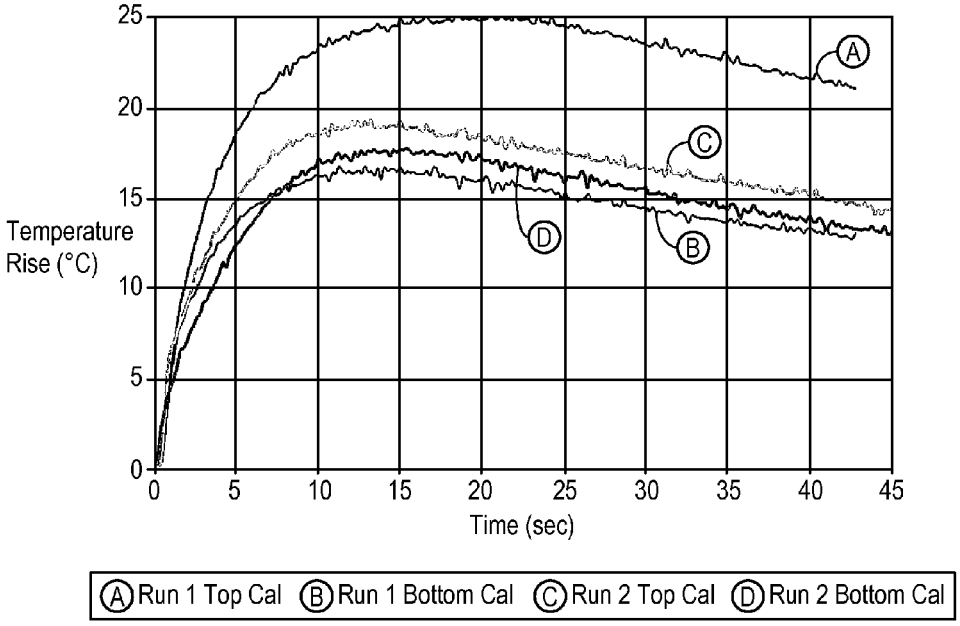
FIG. 4A is a graph showing temperature rise as a function of time while testing an O-Pan based fabric that is not encapsulated in silicone.
Figure 4B:
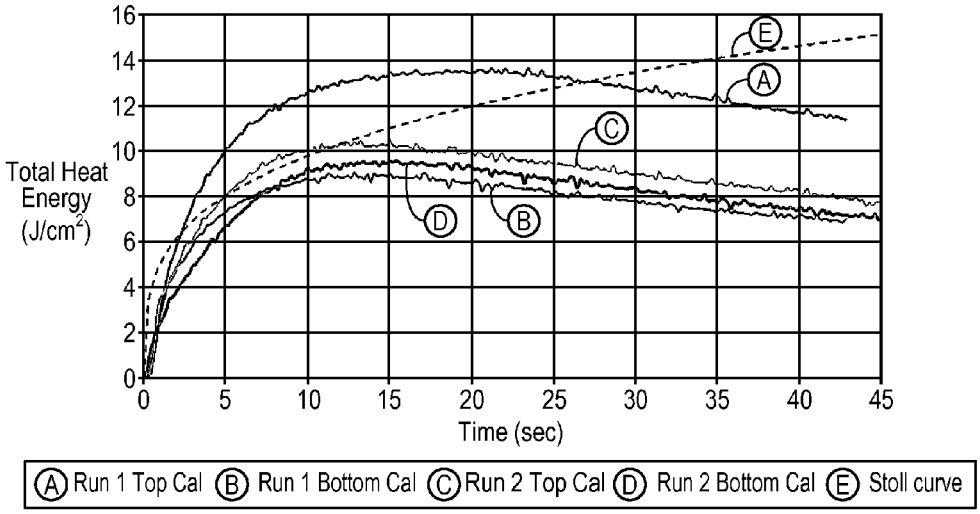
FIG. 4B is a graph showing total heat energy transfer as a function of time of the same O-Pan based fabric evaluated in FIG. 4A.
Figure 5A:
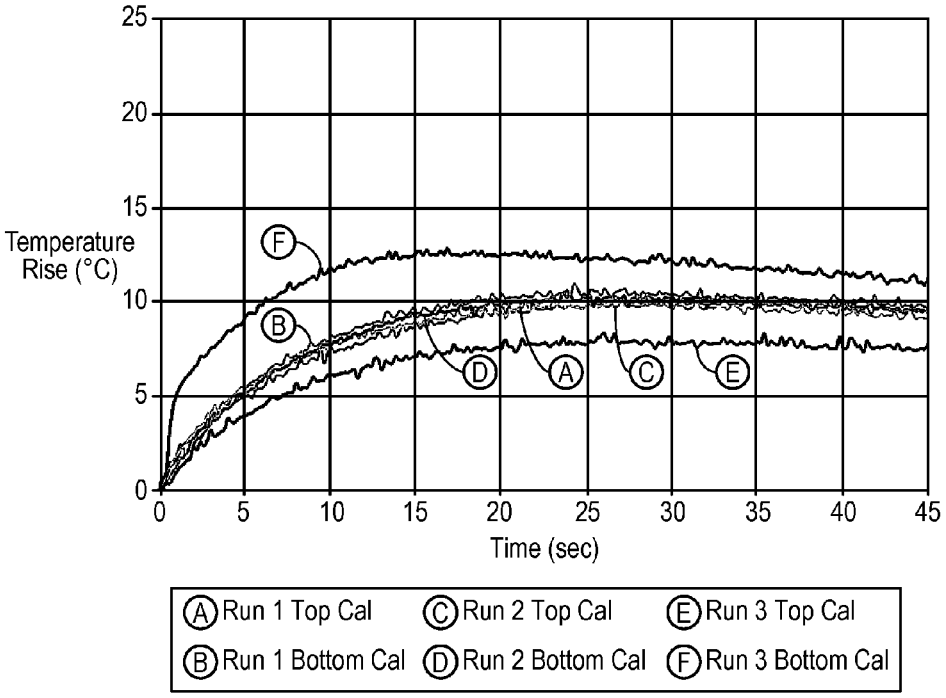
FIG. 5A is a graph showing temperature rise as a function of time while testing an O-Pan based fabric that is encapsulated in silicone.
Figure 5B:
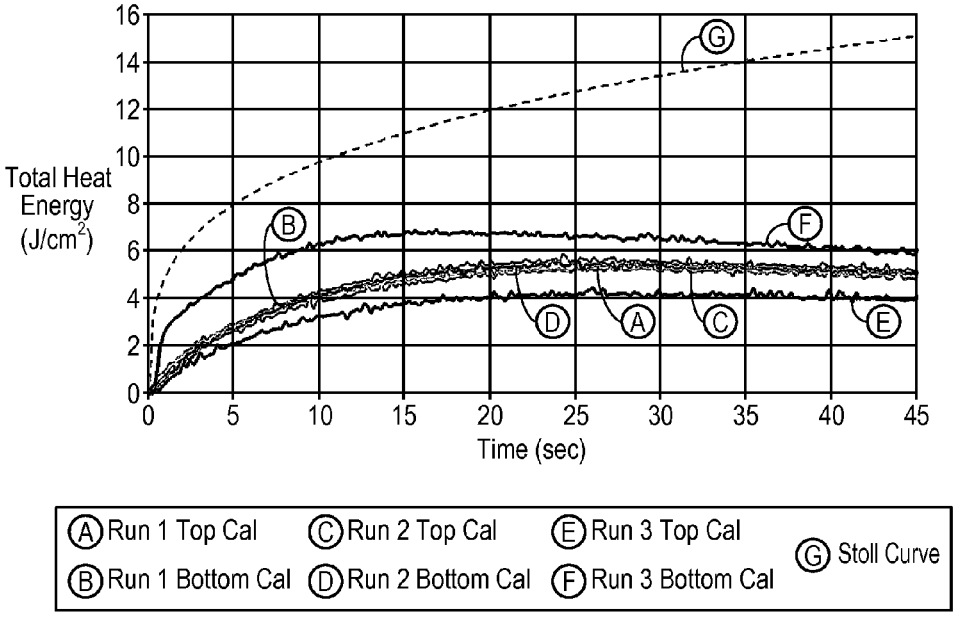
FIG. 5B is a graph showing total heat energy transfer as a function of time of the same silicone encapsulated O-Pan based fabric evaluated in FIG. 5A.

FIG. 4A shows temperature rise at each thermocouple through the C59 fabric not including a silicone-based polymer encapsulation treatment. FIG. 4B shows the heat transfer through the C59 fabric not including the silicone-based polymer encapsulation treatment, as well as the theoretical Stoll Curve. FIG. 5A shows temperature rise at each thermocouple through the C59E fabric including a silicone-based polymer encapsulation treatment. FIG. 5B shows the heat transfer through the C59E fabric including the silicone-based polymer encapsulation treatment, as well as the theoretical Stoll Curve. These results are summarized in Table IV below.

TABLE IV

| Material Designation | Max. ΔT @ Top Calorimeter | Max. ΔT @ Bottom Calorimeter | Time to $2^{nd}$ degree burn |
|---|---|---|---|
| C59 Run 1 | 25.2° C. | 16.7° C. | 2.2 seconds |
| C59 Run 2 | 19.3° C. | 17.7° C. | 4.8 seconds |
| C59E Run 1 | 10.3° C. | 10.9° C. | None |
| C59E Run 2 | 10.1° C. | 10.5° C. | None |
| C59E Run 3 | 8.3° C. | 12.8° C. | None |

As seen, the C59 fabrics alone are only able to slow the occurrence of a second degree burn, which would occur after 2.2 seconds and 4.8 seconds, respectively, according to the tests run. The C59E fabrics which include the silicone treatment, on the other hand, will actually prevent the formation of a second degree burn to the wearer. This is a result of the synergistic combination of the C59 fabric and the silicone polymer encapsulation treatment. In short, the C59 fabric alone is not able to prevent the formation of a second degree burn. Similarly, the use of another fabric (e.g., cotton and/or nylon) encapsulated with silicone (as discussed in, e.g., U.S. Pat. Nos. 4,666,765, 5,004,643, 5,209,965, 5,418,051, 5,856,245, 5,869,172, 5,935,637, 6,040,251, 6,071,602, 6,083,602, 6,129,978, 6,289,841, 6,312,523, 6,342,280 and 6,416,613) was shown by testing to not be able to prevent a second degree burn, as the molten metal would heat the inner core cotton or nylon material, at which point it would decompose or burn, and the fabric would be readily perforated.

The surprising and particularly advantageous result of second degree burn prevention illustrated by the comparative example is possible because of the synergistic effects of the C59 O-Pan based fabric (organic and lightweight) combined with the silicone-based polymer encapsulation treatment applied to the fabric. The silicone-based encapsulation treatment provides the treated fabric with an improved ability to shed the molten metal quickly, rather than allowing it to remain on the treated fabric surface, while the C59 O-Pan based fabric has sufficient fire retardance and heat resistance to maintain fabric integrity and minimize heat conduction to the underlying user's skin.

Comparative Example 2

A sample of a silicone encapsulated fabric according to the Caldwell patents was placed on the molten iron test board described in Comparative Example 1 and sprayed with liquid flammable mineral spirits, which were then ignited. The fabric was made of nylon, which is one of the fabrics disclosed in the Caldwell patents. Within seconds, the Caldwell treated fabric shrunk, charred and perforated, losing all structural integrity. The Caldwell treated fabric would therefore provide no protection to a wearer against second or third degree burns. This demonstrated that the silicone encapsulation treatment of the Caldwell patents, when placed on a conventional fabric as disclosed in the Caldwell patents, does not protect the fabric from complete destruction when contact with a burning liquid mineral spirits and therefore would not protect the wearer form second or third degree burns when exposed to burning liquid mineral spirits or other hot substances.

This test also demonstrated that the operating temperature of the silicone encapsulation treatment disclosed in the Caldwell patents is lower than the temperature of the burning liquid mineral spirits. In light of this, one would not expect the same silicone encapsulation treatment, when applied to the C59 fabric used in Comparative Example 1 to form C59E, to significantly enhance protection to a wearer against second or third degree burns when a wearer of the C59E fabric is exposed to burning liquid mineral spirits compared to the C59 fabric. To determine whether this is true, a further comparative test involving the C59 and C59E fabrics was conducted.

Comparative Example 3

A sample of lightweight C59 fabric placed on the molten iron test board described in Comparative Example 1 and sprayed with liquid flammable mineral spirits, which were then ignited. While the lightweight C59 fabric did not ignite, burn, shrink or char, it lost more than about 90% of its original tear strength (i.e., retained less than about 10% of its original tear strength). This would not have been predicted given the teachings of U.S. Pat. Nos. 6,287,686 and 6,358,608 to Huang et al., U.S. Pat. No. 4,865,906 to Smith, Jr., or U.S. Pat. No. 7,087,300 to Hanyon et al. Nevertheless, the greatly lowered tear strength of the lightweight C59 fabric when exposed to burning flammable liquids and gels might substantially increase the danger to a wearer to second or third degree burns compared to the lightweight C59 fabric before being exposed to burning liquid or gel.

By comparison, a sample of lightweight C59E fabric with the same silicone encapsulation treatment as disclosed in the Caldwell patents was placed on the molten iron test board and sprayed with liquid flammable mineral spirits, which were then ignited. Like the C59 fabric, the lightweight C59E fabric did not ignite, burn, shrink or char and maintained a similar appearance. However, unlike the C59 fabric, the lightweight C59E fabric maintained high tear strength (at least 80-90% of its original tear strength) and is therefore able to provide greatly enhanced protection to a wearer from second or third degree burns when exposed to burning flammable liquids or gels compared to the C59 fabric without silicone encapsulation treatment.

Moreover, given the failure of the Caldwell silicone encapsulation treatment to protect a conventional Caldwell fabric from burning, charring and total destruction, the fact that the same silicone encapsulation treatment increased the tear strength of the lightweight C59E fabric when contacted with burning flammable liquid compared to the untreated lightweight C59 fabric is surprising, unexpected and unpredictable and is therefore suggestive of a synergistic interaction between the O-Pan and aramid fibers of the C59 fabric and the silicone encapsulation treatment of the Caldwell patents.

Comparative Example 4

A sample of a silicone encapsulated fabric according to the Caldwell patents was placed on the molten iron test board described in Comparative Example 1. The fabric was made of nylon, which is one of the fabrics disclosed in the Caldwell patents. Molten zinc (melting point=419.5° C., 787.1° F.) was dripped onto the silicone encapsulated fabric of Caldwell. The molten zinc dripped down the fabric and immediately burned a series of holes right through the fabric and destroyed its structural integrity and ability to protect a wearer from severe burns. This indicates that the silicone encapsulation treatment of the Caldwell patents does not inherently provide protection to either the fabric or a wearer of the fabric against second and third degree burns when splashed with hot molten zinc, which melts at a much lower temperature than molten iron (i.e., 1,535° C. (2,795° F.)).

A sample of lightweight C59E fabric with the same silicone encapsulation treatment as the first fabric tested in this example was placed on the molten iron test board. Molten zinc (melting point=419.5° C., 787.1° F.) was dripped onto the C59E fabric. Most of the molten zinc adhered to the lightweight C59E fabric but did not burn a hole through the fabric. Minor amounts of molten liquid zinc dripped right off the fabric and caused no structural harm to the fabric. This again suggests that the silicone encapsulation treatment of the Caldwell patents synergistically interacted with the O-Pan and aramid fibers of the C59 fabric to provide enhanced protection to both the fabric and wearer of the fabric against second and third degree burns when splashed with hot molten zinc.

Comparative Example 5

Heavy weight asbestos and fiberglass fabrics having a weight between 32-40 oz/yd$^2$ for use in making heavy protective blankets and gloves were compared for high temperature applications. The test results are described in more detail in Dixit, "Performance of Protective Clothing: Development and Testing of Asbestos Substitutes," *Performance of Protective Clothing, ASTM STP* 900, R. L. Barker and G. C. Coletts, Eds., American Society for Testing and Materials, Philadelphia, 1986, pp. 446-460 ("Dixit").

One of the tests employed was the same or similar to the ASTM standard F955-03 iron splash test described in Example 62. In the iron splash test, the asbestos fabric had a weight of 40 oz/yd$^2$, an uncoated fiberglass fabric (Zetex 1200) had a weight of 35 oz/yd$^2$, and a silicone coated fiberglass fabric (Zetex 1200 silicone) had an unspecified weight that was greater than 35 oz/yd$^2$ (perhaps 40 oz/yd$^2$ or greater) as a result of the added weight contributed by the silicone coating. The results of the iron splash test are set forth in Table V below.

TABLE V

| Material Designation | Charring | Shrinkage | Adherence | Perforation |
|---|---|---|---|---|
| Asbestos | 2 | 1 | 4 | 4 |
| Zetex 1200 | 2 | 1 | 3 | 4 |
| Zetex 1200 silicone | 2 | 1 | 1 | 1 |

As can be seen, the heavy, inorganic asbestos and fiberglass fabrics are not prone to charring or shrinkage and therefore the silicone coating did not provide any benefit in either of these two categories. Because the silicone coating was thick and solid, it provided a non-adherent surface to which the molten iron could not adhere, at least at the angle of the test. As a result, the molten iron ran off the surface quickly such that it could not penetrate through and perforate the fabric.

By comparison, silicone encapsulation of the lightweight C59 fabric to form the lightweight C59E fabric as in Comparative Example 1 did in fact reduce both charring and shrinkage, which would not have been predicted in light of the test data contained in Dixit. Adherence and perforation were both reduced or eliminated.

More importantly, the lightweight C59E fabric was able to provide a high level of protection to a user when exposed to bot, burning and/or corrosive materials even though it was lightweight (7.5 oz/yd$^2$), flexible, and breathable, as compared to the Zetex 1200 silicone coated fabric tested in Dixit, which was neither lightweight nor breathable, and had a weight greater than 35 oz/yd$^2$, or about 5 times the weight of the lightweight C59E fabric. The fact that a lightweight protective fabric according to the invention was able to provide good protection even though it had only the fraction of the weight of the Zetex 1200 silicone coated fabric tested in Dixit (i.e., about ⅕ or 20% of Zetex 1200 silicone) is surprising, unexpected, and unpredictable, particularly in view of the other comparative test data showing that silicone encapsulation of fabrics according to the Caldwell patents did not yield fabrics that could withstand catastrophic damage when exposed to molten metals and burning mineral spirits.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A protective article of clothing that is designed to be worn over at least 15% of a user's body and is lightweight and flexible for protection from hot burning flammable materials, hot molten metals, hot high heat capacity materials, hot sparks, burning phosphorus, or hot or corrosive acids, the protective fabric comprising:

a fire retardant and heat resistant core fabric comprised of yarn strands woven, knitted or otherwise joined together so as to be flexible and breathable, the fabric comprising about 40% to about 95% by weight of oxidized polyacrylonitrile and about 5% to about 60% by weight of organic strengthening fibers, including at least aramid fibers; and an elastomeric silicone-based polymer applied to the core fabric in a manner so as to yield a treated fabric that remains lightweight and flexible, has a weight in a range of about 2 oz/yd$^2$ to about 20 oz/yd$^2$, and has enhanced tear strength and enhanced resistance to abrasion, charring and shrinkage compared to the core fabric when contacted with a hot burning flammable materials, hot molten metals, hot high heat capacity materials, hot sparks, burning phosphorus, or hot or corrosive acids.

2. A protective article of clothing as in claim 1, the core fabric comprising about 50% to about 90% by weight oxidized polyacrylonitrile and about 10% to about 50% by weight of organic strengthening fibers.

3. A protective article of clothing as in claim 1, the organic strengthening fibers being selected from the group consisting of p-aramid, m-aramid, polybenzimidazole, polybenzoxazole, polyphenyl ene-2,6-benzobisoxazole, modacrylic, polyvinyl halide, wool, fire resistant polyester, nylon, rayon, cotton, melamine, and mixtures thereof.

4. A protective article of clothing as in claim 1, wherein the treated fabric has a weight that is in a range of about 3 oz/yd$^2$ to about 17 oz/yd$^2$.

5. A protective article of clothing as in claim 1, wherein the treated fabric has a weight that is in a range of about 4 oz/yd$^2$ to about 14 oz/yd$^2$.

6. A protective article of clothing as in claim 1, wherein the treated fabric has a weight that is in a range of about 5 oz/yd$^2$ to about 12 oz/yd$^2$.

7. A protective article of clothing as in claim 1, wherein the article of clothing is designed to be worn over at least 25% of a user's body.

8. A protective article of clothing as in claim 1, wherein the article of clothing is designed to be worn over at least 50% of a user's body.

9. A protective article of clothing as in claim 1, further comprising at least one fluorochemical impregnated within the core fabric.

10. A protective article of clothing as in claim 9, wherein the article of clothing is a jump suit, coat or undergarment having sleeves and/or pant legs.

11. A protective article of clothing as in claim 9, wherein the article of clothing is breathable rather than being a laminate or plugged fabric.

12. A lightweight, flexible, protective article of clothing for protection from hot burning flammable materials, hot molten metals, hot high heat capacity materials, hot sparks, burning phosphorus, or hot or corrosive acids, the protective fabric comprising:

a fire retardant and heat resistant core fabric comprised of yarn strands woven, knitted or otherwise joined together so as to form a protective article of clothing selected from a jump suit, sock, welding bib, welding mask shroud, breacher's coat, protective head gear, or undergarment, the initially untreated yarn strands comprising about 25% to about 99.9% by weight oxidized polyacrylonitrile and about 0.1% to about 75% by weight of organic strengthening fibers selected from the group consisting of p-aramid, m-aramid, polybenzimidazole, polybenzoxazole, polyphenylene-2,6-benzobisoxazole, modacrylic, polyvinyl halide, wool, fire resistant polyester, nylon, rayon, cotton, melamine, and combinations thereof; and an elastomeric silicone-based polymer applied to the core fabric in a manner so as to yield a treated fabric that remains lightweight and flexible, has a weight in a range of about 4 oz/yd$^2$ to about 14 oz/yd$^2$, and has enhanced tear strength and enhanced resistance to abrasion, charring and shrinkage compared to the core fabric when contacted with a hot burning flammable materials, hot molten metals, hot high heat capacity materials, hot sparks, burning phosphorus, or hot or corrosive acids.

13. A lightweight, flexible, protective article of clothing as in claim 12, wherein the elastomeric silicone-based polymer is formed from a curable mixture comprising: (1) at least one organo-hydrosilane polymer or copolymer; (2) at least one vinyl substituted polysiloxane polymer or copolymer; and (3) a catalyst.

14. A lightweight, flexible, protective article of clothing as in claim 13, wherein the curable mixture is shear thinned in order to reduce viscosity during processing and before curing in order to facilitate impregnation of the curable mixture into the fabric and encapsulation of the yarn strands to yield a flexible fabric instead of a stiff laminate structure.

15. A lightweight, flexible, protective article of clothing as in claim 12, the core fabric comprising about 40% to about 95% by weight oxidized polyacrylonitrile and about 5% to about 60% by weight of organic strengthening fibers.

16. A lightweight, flexible, protective article of clothing as in claim 12, the core fabric comprising about 50% to about 90% by weight oxidized polyacrylonitrile and about 10% to about 50% by weight of organic strengthening fibers.

17. A protective article of clothing as in claim 15, the core fabric comprising about 50% to about 90% by weight oxidized polyacrylonitrile and about 10% to about 50% by weight of organic strengthening fibers.

18. A protective article of clothing that is designed to be worn over at least 15% of a user's body and is lightweight and flexible for protection from hot burning flammable materials, hot molten metals, hot high heat capacity materials, hot sparks, burning phosphorus, or hot or corrosive acids, the protective fabric comprising:

a fire retardant and heat resistant core fabric comprised of yarn strands woven, knitted or otherwise joined together so as to be flexible and breathable, the fabric comprising about 40% to about 95% by weight of oxidized polyacrylonitrile and about 5% to about 60% by weight of organic strengthening fibers; and an elastomeric silicone-based polymer applied to the core fabric in a manner so as to yield a treated fabric that remains lightweight and flexible, has a weight in a range of about 4 oz/yd$^2$ to about 14 oz/yd$^2$, and has enhanced tear strength and enhanced resistance to abrasion, charring and shrinkage compared to the core fabric when contacted with a hot burning flammable materials, hot molten metals, hot high heat capacity materials, hot sparks, burning phosphorus, or hot or corrosive acids.

* * * * *